US008794202B2

(12) United States Patent
Suzuki et al.

(10) Patent No.: US 8,794,202 B2
(45) Date of Patent: Aug. 5, 2014

(54) VALVE TIMING CONTROL APPARATUS

(71) Applicant: Aisin Seiki Kabushiki Kaisha, Kariya (JP)

(72) Inventors: Shigemitsu Suzuki, Takahama (JP); Naoto Toma, Kariya (JP); Hiroki Mukaide, Chiryu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/902,143

(22) Filed: May 24, 2013

(65) Prior Publication Data

US 2013/0319357 A1 Dec. 5, 2013

(30) Foreign Application Priority Data

May 30, 2012 (JP) ..... 2012-123441
May 30, 2012 (JP) ..... 2012-123442

(51) Int. Cl.

*F01L 1/34* (2006.01)
*F01L 1/344* (2006.01)
*F02N 19/00* (2010.01)
*F02N 11/08* (2006.01)

(52) U.S. Cl.

CPC ..... *F01L 1/344* (2013.01); *F01L 2001/34466* (2013.01); *F01L 1/3442* (2013.01); *F01L 2001/34459* (2013.01); *F02N 19/004* (2013.01); *F01L 2001/34463* (2013.01); *F01L 2001/34473* (2013.01); *F02N 11/0814* (2013.01)

USPC ..... 123/90.17; 123/90.15

(58) Field of Classification Search

USPC ..... 123/90.15, 90.17, 90.31
See application file for complete search history.

(56) References Cited

U.S. PATENT DOCUMENTS

| | | | | |
|---|---|---|---|---|
| 8,418,664 | B2 | 4/2013 | Suzuki et al. | |
| 2010/0212615 | A1 * | 8/2010 | Suzuki et al. | 123/90.17 |
| 2011/0162603 | A1 | 7/2011 | Busse | |
| 2012/0152190 | A1 | 6/2012 | Kobayashi et al. | |

FOREIGN PATENT DOCUMENTS

| | | | |
|---|---|---|---|
| EP | 2 157 291 | A1 | 2/2010 |
| JP | 2011-1852 | A | 1/2011 |
| WO | 2011/055589 | A1 | 5/2011 |

OTHER PUBLICATIONS

Extended European Search Report issued on Oct. 17, 2013, by the European Patent Office in corresponding European Patent Application No. 13169793.0-1603 (4 pages).

* cited by examiner

*Primary Examiner* — Zelalem Eshete
(74) *Attorney, Agent, or Firm* — Buchanan Ingersoll & Rooney PC

(57) ABSTRACT

A valve timing control apparatus includes a driving-side rotation member, a driven-side rotation member, a fluid chamber, an advanced angle chamber and a retarded angle chamber, a fluid control mechanism, a first intermediate lock mechanism configured to selectively lock a relative rotation phase of the driven-side rotation member relative to the driving-side rotation member at a first intermediate lock phase and release a locked state of the relative rotation phase at the first intermediate lock phase, a most retarded angle lock mechanism configured to selectively lock the relative rotation phase at a most retarded angle lock phase and release a locked state of the relative rotation phase at the most retarded angle lock phase, and a second intermediate lock mechanism configured to selectively lock the relative rotation phase at a second intermediate lock phase and release a locked state of the relative rotation phase at the second intermediate lock phase.

14 Claims, 11 Drawing Sheets

VALVE TIMING CONTROL APPARATUS

CROSS REFERENCE TO RELATED APPLICATIONS

This application is based on and claims priority under 35 U.S.C. §119 to Japanese Patent Application 2012-123441, filed on May 30, 2012, and Japanese Patent Application 2012-123442, filed on May 30, 2012, the entire contents of which are incorporated herein by reference.

TECHNICAL FIELD

This disclosure generally relates to a valve timing control apparatus for controlling a relative rotation phase of a driven-side rotation member relative to a driving-side rotation member rotating in synchronization with a crankshaft of an internal combustion engine.

BACKGROUND DISCUSSION

A valve timing control apparatus configured to change an opening and closing timing of an intake valve and an exhaust valve depending on an operation condition of an internal combustion engine (which will be hereinafter referred to as an engine) has been developed. Such valve timing control apparatus includes, for example, a configuration in which a relative rotation phase of a driven-side rotation member relative to a driving-side rotation member that rotates by an engine operation is changed so as to change the opening and closing timing of the intake valve and the exhaust valve opening and closing in association with the rotation of the driven-side rotation member.

An optimum opening and closing timing of the intake valve and the exhaust valve depends on the operating condition of the engine, for example, depends on whether the engine is started or the vehicle is being driven. At a time of the engine start, the relative rotation phase of the driven-side rotation member relative to the driving-side rotation member is locked at a predetermined phase so as to realize the optimum opening and closing timing of the intake valve and the exhaust valve. At this time, however, in a case where the relative rotation phase is maintained at the aforementioned predetermined rotation phase during an idling of the engine after the engine start, hydrocarbon emissions (HC emissions) may increase. Thus, during the idling of the engine after the engine start, the relative rotation phase is desired to be changed to a certain phase at which the HC emissions are restrained.

JP2011-1852A, which will be hereinafter referred to as Reference 1, discloses a valve timing control apparatus including an inner rotor arranged at an inside of a housing that is connected to a camshaft. The inner rotor serves as the driven-side rotation member while the housing serves as the driving-side rotation member. According to the valve timing control apparatus disclosed in Reference 1, fluid chambers are defined by the housing and the inner rotor. Then, each of the fluid chambers is divided by a vane serving as a partition member into an advanced angle chamber and a retarded angle chamber. In addition, an oil control valve (OCV) for relative rotation is provided to select one of the retarded angle chamber and the advanced angle chamber for supplying hydraulic oil serving as fluid to the selected chamber, thereby shifting the relative rotation phase between the housing and the inner rotor in either a retarded angle direction or an advanced angle direction. Further, a torsion spring is provided to extend from the inner rotor to the housing for biasing and displacing the relative rotation phase in the advanced angle direction.

According to the valve timing control apparatus disclosed in Reference 1, a first restriction member and a second restriction member are provided at the housing. In addition, a first restriction groove engaging with the first restriction member and a second restriction groove engaging with the second restriction member are formed at the inner rotor. The first restriction member and the second restriction member are insertable and retractable relative to the first restriction groove and the second restriction groove respectively. The first restriction member and the second restriction member project into the first restriction groove and the second restriction groove by means of a biasing force of the torsion spring. Further, a first connection passage for applying a pressure of hydraulic oil in a direction in which the first restriction member is retracted from the first restriction groove and a second connection passage for applying a pressure of hydraulic oil in a direction in which the second restriction member is retracted from the second restriction groove are formed at the inner rotor.

The first restriction member is fitted to the first restriction groove while the second restriction member is fitted to the second restriction groove to thereby obtain an intermediate lock phase. In addition, the second restriction member is retracted from the second restriction groove while the first restriction member makes contact with an end portion of the first restriction groove at a retarded angle side to thereby obtain a retarded angle restriction phase.

According to the aforementioned valve timing control apparatus disclosed in Reference 1, an oil control valve (OCV) for restriction portion is provided to supply the hydraulic oil separately and individually to the first restriction groove and the second restriction groove. As a result, the first restriction member and the second restriction member are retracted from the respective first restriction groove and the second restriction groove individually and separately, i.e., the retraction of the first restriction member from the first restriction groove is separately conducted from the retraction of the second restriction member from the second restriction groove. According to the OCV for restriction portion, the relative rotation phase is locked at the intermediate lock phase at which an improved startability of the engine is obtained when the engine is started. On the other hand, the relative rotation phase is restricted or locked at the retarded angle restriction phase positioned at the retarded angle side relative to the intermediate lock phase by the displacement of the relative rotation phase to the retarded angle side to thereby restrain the HC emissions during the idling of the engine after the engine start.

Generally, the inner rotor receives a displacing force in the advanced angle direction and a displacing force in the retarded angle direction based on a torque fluctuation of the camshaft. Specifically, the average displacing force is applied in the retarded angle direction so as to displace the inner rotor in the retarded angle direction. Hereinafter, the average of displacing forces in the retarded angle direction and the advanced angle direction based on the torque fluctuation of the camshaft will be described as an "average displacing force in the retarded angle direction based on the torque fluctuation of the camshaft". According to the valve timing control apparatus, the relative rotation phase may be smoothly and promptly displaced in the advanced angle direction by the torsion spring regardless of the average displacing force in the retarded angle direction based on the torque fluctuation of the camshaft.

In view of environmental concerns, recent vehicles are equipped with an idling stop function for temporarily stopping the engine operation when stopping at a red light, for example, during the driving. In the idling stop state, the relative rotation phase is shifted to the most retarded angle phase to stop the engine because of the following reason. Because the engine is at a high temperature in the idling stop state, an ignition of air-fuel mixture for starting the engine may be easily performed when the engine is started with the relative rotation phase at the most retarded angle phase. In addition, in a case of cranking of the engine with the relative rotation phase at the most retarded angle phase, the rotation of the crankshaft may be smoothly started at a low load.

In a case where the engine is started while the engine is at a high temperature, however, a supply pressure of hydraulic oil is relatively low because of a high temperature and a low viscosity of hydraulic oil in addition to the low rotation speed of the engine. Thus, the supply pressure of hydraulic oil may not be sufficient for stably holding or maintaining the relative rotation phase.

During the operations of the inner rotor and the vanes at the time of the engine start in the idling stop state, according to the valve timing control apparatus disclosed in Reference 1, the displacing forces in the retarded angle direction and the advanced angle direction based on the torque fluctuation of the camshaft and the biasing force of the torsion spring are dominant over the supply pressure of hydraulic oil. That is, the average displacing force in the advanced angle direction based on the torque fluctuation of the camshaft is offset by the biasing force of the torsion spring in the advanced angle direction, which may inhibit the relative rotation phase from being stably maintained. Therefore, at the most retarded angle phase at which the housing and the inner rotor are inhibited from being mechanically locked or restricted, the inner rotor and the vanes move in the retarded angle direction and the advanced angle direction, which may cause each of the vanes to hit a wall surface of the fluid pressure chamber, thereby generating a hitting sound.

A need thus exists for a valve timing control apparatus which is not susceptible to the drawback mentioned above.

SUMMARY

According to an aspect of this disclosure, a valve timing control apparatus includes a driving-side rotation member rotating in synchronization with a crankshaft of an internal combustion engine, a driven-side rotation member arranged coaxial with the driving-side rotation member and rotating in synchronization with a camshaft for opening and closing a valve of the internal combustion engine, a fluid chamber formed by the driving-side rotation member and the driven-side rotation member, an advanced angle chamber and a retarded angle chamber formed by divided portions of the fluid chamber divided by a partition member that is provided at at least one of the driving-side rotation member and the driven-side rotation member, a fluid control mechanism controlling supply and discharge of fluid relative to the fluid chamber, a first intermediate lock mechanism configured to selectively lock a relative rotation phase of the driven-side rotation member relative to the driving-side rotation member at a first intermediate lock phase between a most advanced angle phase and a most retarded angle phase and release a locked state of the relative rotation phase at the first intermediate lock phase, a most retarded angle lock mechanism configured to selectively lock the relative rotation phase at a most retarded angle lock phase and release a locked state of the relative rotation phase at the most retarded angle lock phase, and a second intermediate lock mechanism configured to selectively lock the relative rotation phase at a second intermediate lock phase between the first intermediate lock phase and the most retarded angle lock phase and release a locked state of the relative rotation phase at the second intermediate lock phase.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
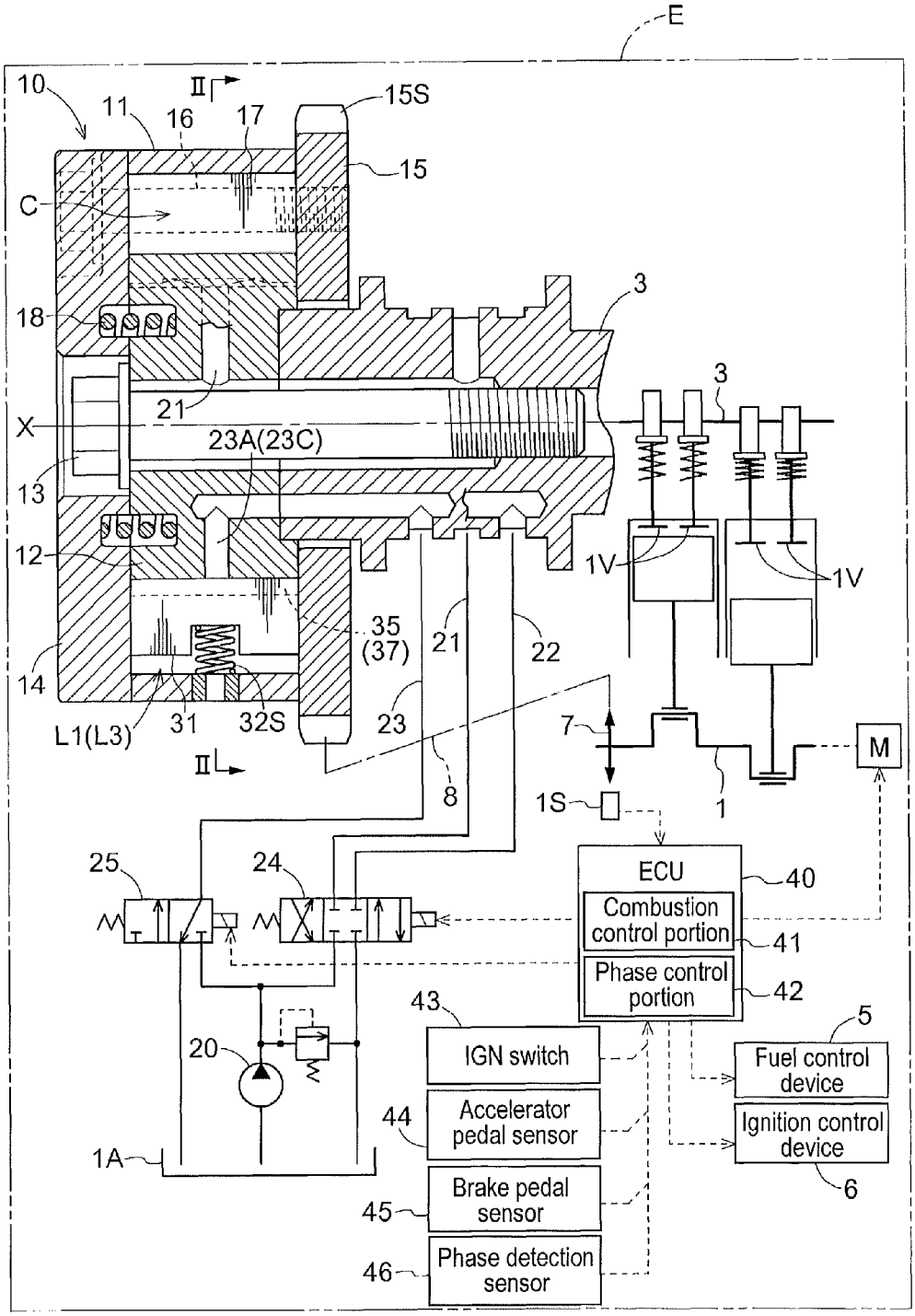
FIG. 1 is a vertical sectional view illustrating a configuration of a valve timing control apparatus according to a first embodiment disclosed here.
Figure 2:
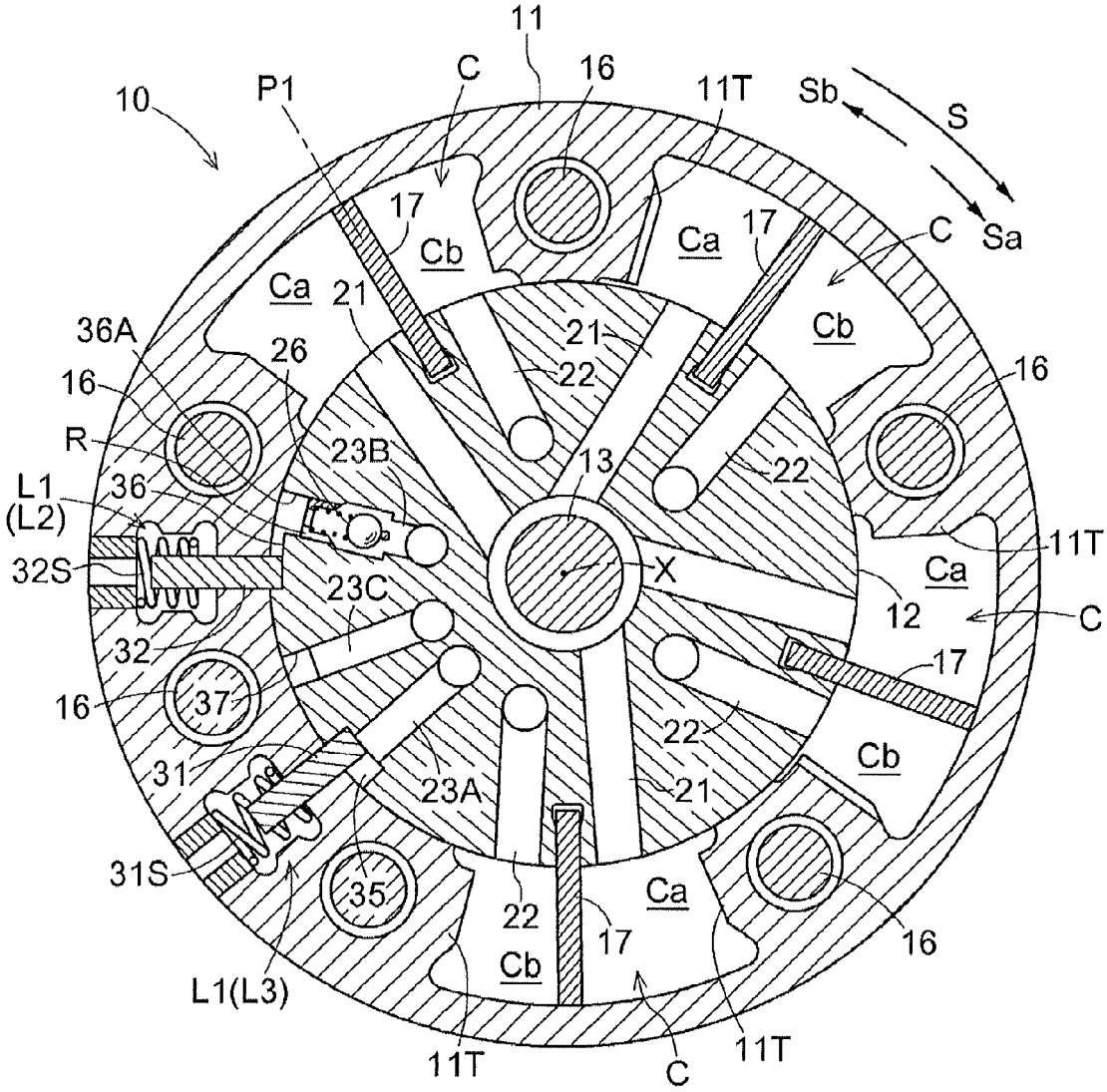
FIG. 2 is a cross-sectional view taken along line II-II in FIG. 1 and illustrating a first intermediate lock phase of the valve timing control apparatus.

A first embodiment will be explained with reference to FIGS. 1 to 12. As illustrated in FIGS. 1 and 2, an internal combustion engine control system includes an engine control unit (ECU) 40 serving as a control unit for controlling an engine E serving as an internal combustion engine and a valve timing control apparatus 10 that specifies an opening and closing timing of an intake valve 1V of the engine E.

The internal combustion engine control system according to the present embodiment realizes an idling stop control for stopping the engine E in a case where a vehicle is stopped at a red light, for example. The internal combustion engine control system according to the present embodiment may be used to control the valve timing control apparatus 10 and the engine E in a hybrid vehicle, for example, that stops and starts on a frequency basis.

The engine E illustrated in FIG. 1, which is mounted to a passenger vehicle, for example, includes a starter motor M transmitting a drive rotation force to a crankshaft 1, a fuel control device 5 controlling a fuel injection relative to an intake port or a combustion chamber, an ignition control device 6 controlling an ignition of a spark plug, and a shaft sensor 1S detecting a rotation angle and a rotation speed of the crankshaft 1. A phase detection sensor 46 detecting a relative rotation phase of an inner rotor 12 relative to an outer rotor 11 and is provided at the valve timing control apparatus 10.

The ECU 40 includes an engine control portion 41 and a phase control portion 42. The engine control portion 41 performs an automatic start and an automatic stop, for example, of the engine E. The phase control portion 42 controls the relative rotation phase and a lock mechanism of the valve timing control apparatus 10. Control structure and method related to the ECU 40 will be explained later.

As illustrated in FIG. 1, the valve timing control apparatus 10 includes the outer rotor 11 serving as a driving-side rotation member that rotates in synchronization with the crankshaft 1 of the engine E, and the inner rotor 12 serving as a driven-side rotation member and connected to a camshaft 3 via a connection bolt 13 for opening and closing the intake valve 1V in a combustion chamber of the engine E. The inner rotor 12 is arranged coaxially with an axis (an axial line) X of the camshaft 3. The inner rotor 12 and the outer rotor 11 are configured to be relatively rotatable about the axis X.

The inner rotor 12 and the outer rotor 11, which are arranged coaxially with the axis X, are tightened by a fastening bolt 16 in a state to be sandwiched between a front plate 14 and a rear plate 15. A timing sprocket 15S is formed at an outer periphery of the rear plate 15. The inner rotor 12 is arranged in a state where a center portion of the inner rotor 12 penetrates through an opening formed at a center of the rear plate 15. The camshaft 3 at an intake side is connected to an end portion of the inner rotor 12 at which the rear plate 15 is provided.

As illustrated in FIG. 2, plural projection portions 11T are integrally formed at the outer rotor 11 so as to project towards the axis X, i.e., to a radially inner side. The inner rotor 12 is formed in a column including an outer periphery that makes a close contact with respective projection edges of the plural projection portions 11T. Then, fluid chambers C are formed between the projection portions 11T, specifically, each of the fluid chambers C is formed between the adjacent projection portions 11T in a rotation direction of the inner rotor 12 and the outer rotor 11. In addition, plural vanes 17, each serving as a partition member, are fitted to an outer periphery of the inner rotor 12 while projecting towards the respective fluid chambers C. Each of the fluid chambers C defined by the vane 17 is divided into an advanced angle chamber Ca and a retarded angle chamber Cb in the rotation direction.

As illustrated in FIG. 1, a torsion spring 18 is disposed between the inner rotor 12 and the front plate 14 to generate a biasing force until the relative rotation phase of the inner rotor 12 relative to the outer rotor 11 (which will be hereinafter simply referred to as the "relative rotation phase") reaches a first intermediate lock phase P1 from a most retarded angle state. Alternatively, the torsion spring 18 may generate the biasing force so that the relative rotation phase goes beyond the first intermediate lock phase P1 or fails to reach the first intermediate lock phase P1.

In the valve timing control apparatus 10, a timing chain 8 is wound over an output sprocket 7 provided at the crankshaft 1 of the engine E and the timing sprocket 15S of the outer rotor 11 so that the outer rotor 11 rotates in synchronization with the crankshaft 1. An apparatus including a similar configuration to that of the valve timing control apparatus 10 is provided at an end portion of the camshaft 3 at an exhaust side, which is not shown in drawings. A rotation force is also transmitted from the timing chain 8 to the apparatus.

As illustrated in FIG. 2, the outer rotor 11 in the valve timing control apparatus 10 rotates in a driving rotation direction S by a driving force from the crankshaft 1. According to the present embodiment, a direction in which the inner rotor 12 rotates in the same direction as the driving rotation direction S relative to the outer rotor 11 is defined to be an advanced angle direction Sa. In addition, a direction in which the inner rotor 12 rotates in a different direction from the driving rotation direction S relative to the outer rotor 11 is defined to be a retarded angle direction Sb. According to the valve timing control apparatus 10 of the present embodiment, the relation between the crankshaft 1 and the camshaft 3 is specified so that a compression ratio of intake air is enhanced in association with an increase of a displacement amount obtained when the relative rotation phase is displaced in the advanced angle direction Sa. In addition, the compression ratio of intake air is reduced in association with an increase of the displacement amount in a case where the relative rotation phase is displaced in the retarded angle direction Sb.

Each of the fluid chambers C is divided by the vane 17 into the advanced angle chamber Ca into which hydraulic oil serving as fluid is supplied to thereby displace the relative rotation phase in the advanced angle direction Sa, and into the retarded angle chamber Cb into which the hydraulic oil is supplied to thereby displace the relative rotation phase in the retarded angle direction Sb. The relative rotation phase obtained in a state where the vane 17 is positioned at a moving end (i.e., a pivotal end relative to the axis X) in the advanced angle direction is defined to be the most advanced angle phase while the relative rotation phase obtained in a state where the vane 17 is positioned at a moving end (i.e., a pivotal end relative to the axis X) in the retarded angle direction is defined to be the most retarded angle phase. In this case, the most advanced angle phase includes not only the moving end in the advanced angle direction of the vane 17 but also the vicinity of the moving end in the advanced direction. In the same way, the most retarded angle phase includes not only the moving end in the retarded angle direction of the vane 17 but also the vicinity of the moving end in the retarded angle direction.

The inner rotor 12 includes an advanced angle control oil passage 21 connected to the advanced angle chambers Ca, a retarded angle control oil passage 22 connected to the retarded angle chambers Cb, and a main release oil passage 23 serving as an example of a main release flow passage and a common flow passage and supplying the hydraulic oil to the lock mechanism, specifically, three lock mechanisms which will be explained later. According to the valve timing control apparatus 10 of the embodiment, lubricant oil stored at an oil pan 1A of the engine E is used as the hydraulic oil (fluid) that is supplied to the advanced angle chambers Ca or the retarded angle chambers Cb.

Figure 3:
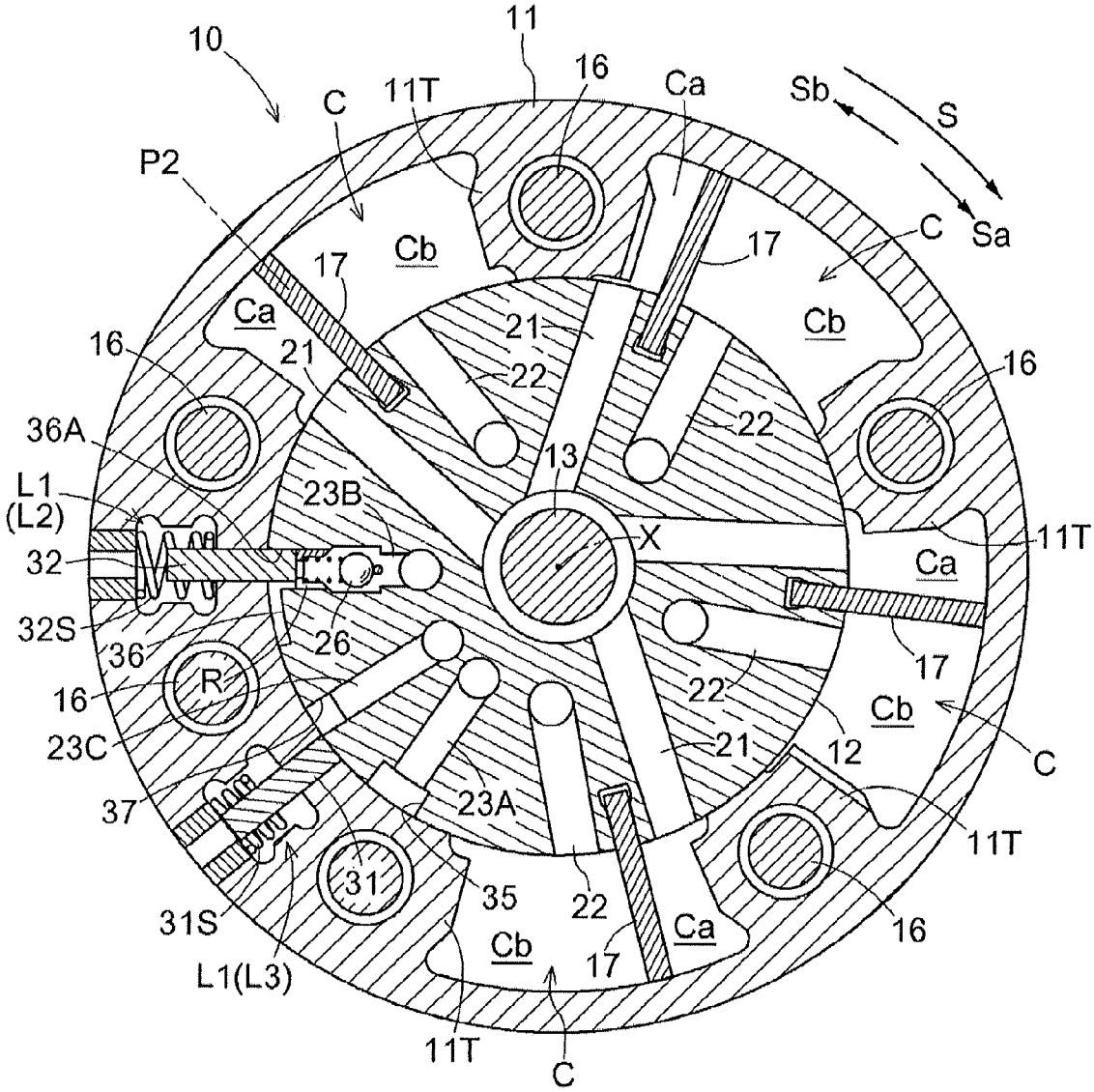
FIG. 3 is a cross-sectional view illustrating a second intermediate lock phase of the valve timing control apparatus.
Figure 4:
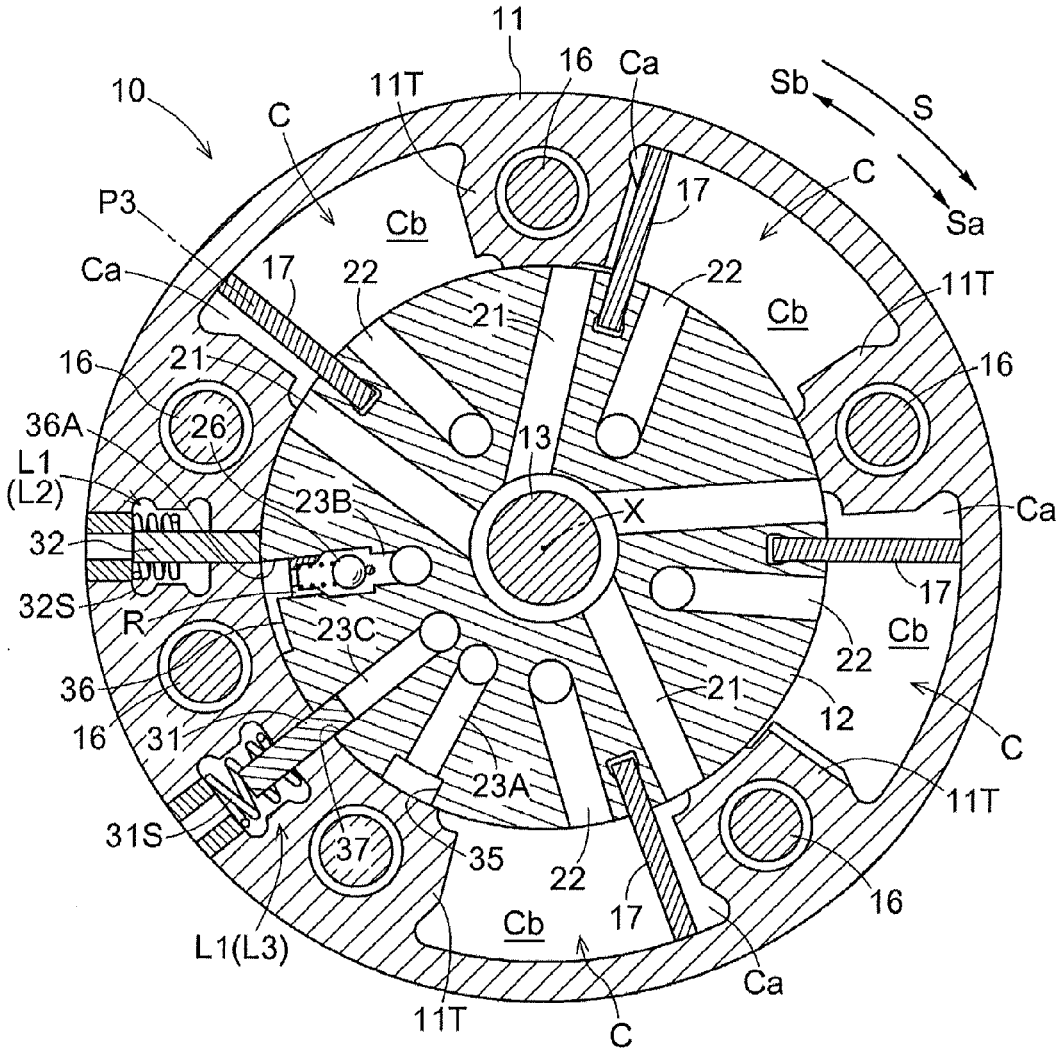
FIG. 4 is a cross-sectional view illustrating a most retarded angle lock phase of the valve timing control apparatus.

As illustrated in FIGS. 2 to 4, the valve timing control apparatus 10 includes the three lock mechanisms, i.e., a first intermediate lock mechanism L1 serving as an example of a restraint mechanism, a second intermediate lock mechanism L2 serving as an example of a restriction mechanism, and a most retarded angle lock mechanism L3. The first intermediate lock mechanism L1 selectively locks the relative rotation phase at the first intermediate lock phase P1 as illustrated in FIG. 2 and releases the locked state of the relative rotation phase at the first intermediate lock phase P1. The second intermediate lock mechanism L2 selectively locks the relative rotation phase at a second intermediate lock phase P2 as illustrated in FIG. 3 positioned in the retarded angle direction Sb relative to the first intermediate lock phase P1 and releases the locked state of the relative rotation phase at the second intermediate lock phase P2. The most retarded angle lock mechanism L3 selectively locks the relative rotation phase at a most retarded angle lock phase P3 corresponding to the most retarded angle phase as illustrated in FIG. 4 and releases the locked state of the relative rotation phase at the most retarded angle lock phase P3.

The first intermediate lock phase P1 is specified at a predetermined phase between the most advanced angle phase serving as an operating end in the advanced angle direction Sa, and the most retarded angle phase serving as an operating end in the retarded angle direction Sb. The first intermediate lock phase P1 is a phase in which the engine E at a low temperature state may be effectively started. The second intermediate lock phase P2 is a phase in which HC emissions may be reduced during the idling of the engine E after the start of the engine E. The most retarded angle lock phase P3 is a phase in which the engine E that is stopped at a high temperature state (i.e., the engine E has not been stopped for a long time period) may be cranked at a low torque.

As illustrated in FIGS. 2 to 4, each of the first intermediate lock mechanism L1, the second intermediate lock mechanism L2, and the most retarded angle lock mechanism L3 is constituted by a combination of a first lock member 31, a second lock member 32, a first recess portion 35, a second recess portion 36, and a third recess portion 37.

Each of the first lock member 31 and the second lock member 32 formed by a plate member is supported by the outer rotor 11 so as to be projectable and retractable relative to the outer rotor 11. Each of the first lock member 31 and the second lock member 32 is configured to approach and separate relative to the axis X while keeping parallel to the axis X. The first lock member 31 projects towards the inner rotor 12 by a biasing force of a first spring 31S while the second lock member 32 projects towards the inner rotor 12 by a biasing force of a second spring 32S.

The first recess portion 35 is formed at an outer periphery of the inner rotor 12 in a groove shape along the axis X. A groove width of the first recess portion 35 in a circumferential direction of the inner rotor 12 is greater than a thickness of the first lock member 31. The second recess portion 36 is formed at the outer periphery of the inner rotor 12 in a groove shape along the axis X. A groove depth, i.e., an axial length, of the second recess portion 36 is smaller than a groove depth of the first recess portion 35. A fitting recess portion 36A configured to be fitted to the second lock member 32 is provided at an end portion of the second recess portion 36 in the advanced angle direction so as to be integrally formed with the second recess portion 36. A groove depth of the fitting recess portion 36A is the same as that of the first recess portion 35. A groove width of the second recess portion 36 in the circumferential direction is greater than that of the first recess portion 35. A groove width of the fitting recess portion 36A in the circumferential direction is specified so that the second lock member 32 is fitted to the fitting recess portion 36A without a clearance or a gap in the circumferential direction. The third recess portion 37 is formed in a groove along the axis X. A groove width of the third recess portion 37 in the circumferential direction is formed so that the first lock member 31 is fitted to the third recess portion 37 without a clearance or a gap in the circumferential direction.

In the first intermediate lock phase P1 as illustrated in FIG. 2, the first lock member 31 fitted to or engaging with the first recess portion 35 is in contact with an end portion of an inner surface of the first recess portion 35 in the advanced angle direction Sa. In addition, the second lock member 32 fitted to or engaging with the second recess portion 36 is in contact with an end portion of an inner surface of the second recess portion 36 in the retarded angle direction Sb.

As mentioned above, the first intermediate lock mechanism L1 is constituted by the first lock member 31, the first recess portion 35, the second lock member 32, and the second recess portion 36 to thereby lock the relative rotation phase at the first intermediate lock phase P1.

The second intermediate lock phase P2 as illustrated in FIG. 3 is obtained in a case where the first lock member 31 is retracted from the first recess portion 35 in a state where the relative rotation phase is at the first intermediate lock phase P1, and then the relative rotation phase is shifted in the retarded angle direction Sb so that the second lock member 32 is fitted to the fitting recess portion 36A.

Accordingly, the second intermediate lock mechanism L2 is constituted by the second lock member 32 and the second recess portion 36, specifically, the fitting recess portion 36A, to thereby lock the relative rotation phase at the second intermediate lock phase P2.

In the second intermediate lock phase P2, the second lock member 32 is not necessary fitted to the fitting recess portion 36A. The second intermediate lock mechanism L2 may be constituted without the fitting recess portion 36A, i.e., constituted by the second lock member 32 and the second recess portion 36 formed in a shallow groove. In the configuration where the fitting recess portion 36A is not provided, the second lock member 32 is in contact with a wall surface of the second recess portion 36 in the retarded angle direction Sb at the second intermediate lock phase P2 to thereby restrict the relative rotation between the inner rotor 12 and the outer rotor 11.

The most retarded angle lock phase P3 as illustrated in FIG. 4 is obtained in a case where the second lock member 32 is retracted from the second recess portion 36 in a state where the relative rotation phase is at the second intermediate lock phase P2, and then the relative rotation phase is further shifted in the retarded angle direction Sb so that the first lock member 31 is fitted to the third recess portion 37.

According to the valve timing control apparatus 10 of the present embodiment, the lock member and the recess portion are not necessarily individually provided for each of the first intermediate lock mechanism L1, the second intermediate lock mechanism L2, and the most retarded angle lock mechanism L3. Each of the first intermediate lock mechanism L1, the second intermediate lock mechanism L2, and the most retarded angle lock mechanism L3 is formed by a combination of the first lock member 31, the second lock member 32, the first recess portion 35, the second recess portion 36, and the third recess portion 37. Therefore, the number of components, cost, and size of the valve timing control apparatus 10 may be reduced.

As illustrated in FIGS. 2 to 4, a first release oil passage 23A serving as a first release flow passage, a second release oil passage 23B serving as a second release flow passage, and a third release oil passage 23C serving as a third release flow passage are formed at the inner rotor 12. The first release oil passage 23A supplies the hydraulic oil to the first recess portion 35 from the main release oil passage 23 and discharges the hydraulic oil from the first recess portion 35 to the main release oil passage 23. The second release oil passage 23B supplies the hydraulic oil to the second recess portion 36 from the main release oil passage 23 and discharges the hydraulic oil from the second recess portion 36 to the main release oil passage 23. The third release oil passage 23C supplies the hydraulic oil to the third recess portion 37 from the main release oil passage 23 and discharges the hydraulic oil from the third recess portion 37 to the main release oil passage 23. The main release oil passage 23 (the common flow passage) serves as a common portion of the oil passages supplying and discharging the hydraulic oil to the first intermediate lock mechanism L1, the second intermediate lock mechanism L2, and the most retarded angle lock mechanism L3 respectively. In addition, the first release oil passage 23A supplies the hydraulic oil in a direction for retracting the first lock member 31 from the first recess portion 35 while the second release oil passage 23B supplies the hydraulic oil in a direction for retracting the second lock member 32 from the second recess portion 36. The first release oil passage 23A and the second release oil passage 23B are configured to be supplied with the hydraulic oil from the single main release oil passage 23.

Specifically, in order to restrain a flow of hydraulic oil supplied to the second recess portion 36 through the second release oil passage 23B from the main release oil passage 23, an orifice portion R is provided as a delay portion. As mentioned above, the fitting recess portion 36A is formed at the second recess portion 36. The orifice portion R is formed at the second release oil passage 23B connected to a radially inner side of the fitting recess portion 36A.

Figure 5:
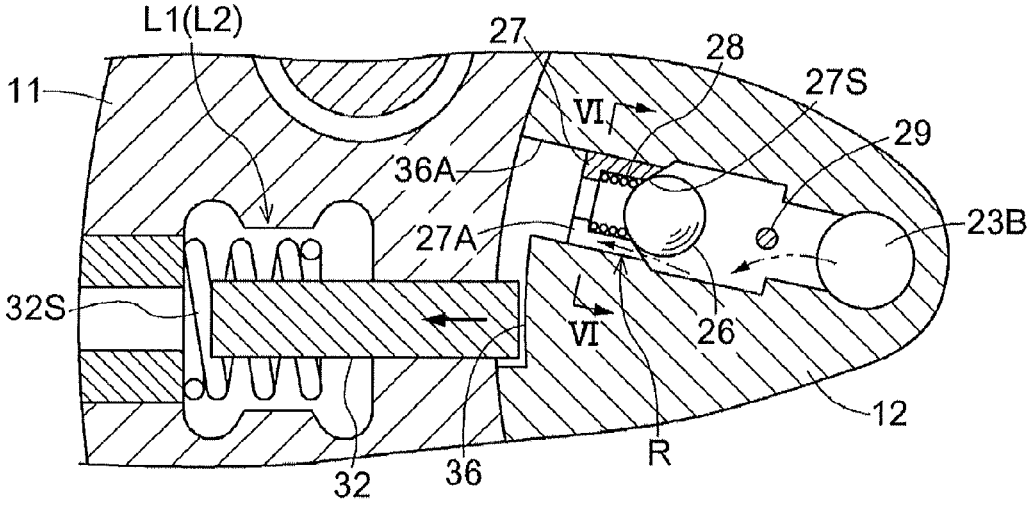
FIG. 5 is a cross-sectional view illustrating a configuration of an orifice portion according to the first embodiment.
Figure 6:
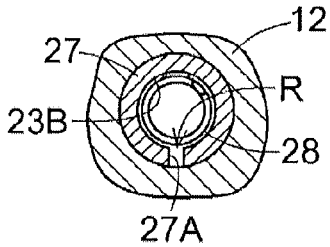
FIG. 6 is a cross-sectional view taken along line VI-VI in FIG. 5.

As illustrated in FIG. 5, the orifice portion R includes a ball 26, a seat 27, a contact surface 27S, and a spring 28. The ball 26 serving as a flow control member is movably accommodated within the second release oil passage 23B. The seat 27 having a cylindrical shape is fitted to the second release oil passage 23B. The ball 26 makes contact with the contact surface 27S formed in a horn shape. The spring 28 is disposed between the seat 27 and the ball 26 so as to apply a biasing force in a direction where the ball 26 is separated from the contact surface 27S. A groove portion 27A is formed at the seat 27 so that the flow of hydraulic oil is available even when the ball 26 is in contact with the contact surface 27S. As illustrated in FIG. 6, a cross section of flow passage of the groove portion 27A is smaller than a cross section of flow passage of the first release oil passage 23A. Thus, the hydraulic oil flowing through the second release oil passage 23B (specifically, the groove portion 27A) generates a higher flow passage resistance than the hydraulic oil flowing through the first release oil passage 23A in a case where the ball 26 is in contact with the contact surface 27S.

The spring 28 is provided to inhibit the ball 26, by means of a biasing force, from making contact with the contact surface 27S by a centrifugal force generated when the inner rotor 12 rotates. A restriction pin 29 is formed at an inner portion of the second release oil passage 23B so as to determine the position of the ball 26 by making contact with the ball 26 while the biasing force of the spring 28 is being applied.

According to the aforementioned configuration, in a case where the hydraulic oil is supplied to the second lock member 32 from the main release oil passage 23, the pressure of hydraulic oil (oil pressure) exceeds the biasing force of the spring 28 so that the ball 26 makes contact with the contact surface 27S. Thus, the hydraulic oil flows only through the groove portion 27A at the orifice portion R. Because of the reduced cross section of flow passage of the groove portion 27A, the flow of hydraulic oil is restrained and limited. In a case where the hydraulic oil is discharged from the second recess portion 36, the ball 26 is separated from the contact surface 27S by the oil pressure or the biasing force of the spring 28 so that the hydraulic oil flows through the second release oil passage 23B at the orifice portion R. As a result, the flow passage resistance when the hydraulic oil is discharged from the second recess portion 36 decreases. The hydraulic oil flowing through the second release oil passage 23B is discharged at substantially the same volume as the hydraulic oil flowing through the first release oil passage 23A to be discharged therefrom.

Accordingly, in a case where the hydraulic oil is supplied to the main release oil passage 23 at the first intermediate lock phase P1, the hydraulic oil is supplied to the first recess portion 35 in a short time. The first lock member 31 may be retracted from the first recess portion 35 in a short time. On the other hand, the hydraulic oil supplied to the second recess portion 36 is limited to flow by means of the orifice portion R. Thus, timing at which the second lock member 32 is retracted from the second recess portion 36 is delayed from timing at which the first lock member 31 is retracted from the first recess portion 35. That is, at a time when the first lock member 31 is retracted from the first recess portion 35, the second lock member 32 is still fitted to the second recess portion 36 and the fitting state therebetween is maintained for a moment. The orifice portion R causes the hydraulic oil to be delayed in reaching the second intermediate lock mechanism L2 as compared to the hydraulic oil to reach the first intermediate lock mechanism L1 in a case where the hydraulic oil is supplied to the first intermediate lock mechanism L1 and the second intermediate lock mechanism L2.

As mentioned above, the delay of retraction of the second lock member 32 from the second recess portion 36 relative to the retraction of the first lock member 31 from the first recess portion 35 is utilized so that the fitting of the second lock member 32 to the second recess portion 36 (i.e., the engagement of the second lock member 32 with the second recess portion 36) is maintained while the first lock member 31 is securely retracted from the first recess portion 35. The relative rotation phase is securely shifted from the first intermediate lock phase P1 to the second intermediate lock phase P2.

The orifice portion R serving as the delay portion may be modified or changed by a replacement of the ball 26 with a poppet valve, for example. In addition, a flow passage for the orifice portion R may be provided in parallel with a flow passage where the ball 26 or the poppet valve is provided. In addition, the orifice portion R may be provided at the first release oil passage 23A instead of the second release oil passage 23B.

Because of the main release oil passage 23, an individual oil passage is not necessarily provided for each of the first intermediate lock mechanism L1, the second intermediate lock mechanism L2, and the most retarded angle lock mechanism L3. Manufacturing man-hours for providing the oil passage may be reduced to thereby achieve a reduced cost of the valve timing control apparatus 10. In addition, the volume occupied by the oil passage is reduced, which may result in a reduced size of the valve timing control apparatus 10.

As illustrated in FIG. 1, the engine E includes a hydraulic pump 20 that suctions the lubricant oil in the oil pan 1A by a driving force of the engine E so as to send out the lubricant oil as the hydraulic oil. The internal combustion engine control system according to the present embodiment includes a phase control valve 24 including a solenoid controlled type and a release control valve 25 including a solenoid controlled type. The hydraulic oil discharged from the hydraulic pump 20 is selectively supplied to the advanced angle chambers Ca or the retarded angle chambers Cb by means of the phase control valve 24. The hydraulic oil discharged from the hydraulic pump 20 is supplied to the main release oil passage 23 by means of the release control valve 25. Specifically, the hydraulic pump 20, the phase control valve 24, the release control valve 25, and the oil passages for which the hydraulic oil is supplied and discharged (i.e., the advanced angle control oil passage 21, the retarded angle control oil passage 22, and the main release oil passage 23) constitute a fluid control mechanism of the valve timing control apparatus 10.

The phase control valve 24 serves as a solenoid valve that is operated to be switchable among an advanced angle position, a retarded angle position, and a neutral position by a control signal from the ECU 40. In the advanced angle position, the hydraulic oil discharged from the hydraulic pump 20 flows through the advanced angle control oil passage 21 to be supplied to the advanced angle chambers Ca while the hydraulic oil in the retarded angle chambers Cb is discharged from the retarded angle control oil passage 22. In the retarded angle position, the hydraulic oil discharged from the hydraulic pump 20 flows through the retarded angle control oil passage 22 to be supplied to the retarded angle chambers Cb while the hydraulic oil in the advanced angle chambers Ca is discharged from the advanced angle control oil passage 21. In the neutral position, the supply and discharge of hydraulic oil is not performed for the advanced angle chambers Ca or the retarded angle chambers Cb. When an electric power is supplied to the phase control valve 24 in a state where the duty ratio is 100%, the phase control valve 24 is brought to the advanced angle position. In a case where the supply of electric power is interrupted to the phase control valve 24, the phase control valve 24 is brought to the retarded angle position.

The release control valve 25 serves as a solenoid valve that is operated to be switchable between an unlocked position and a locked position by a control signal from the ECU 40. In the unlocked position, the hydraulic oil discharged from the hydraulic pump 20 flows through the main release oil passage 23 to be supplied to the first recess portion 35, the second recess portion 36, and the third recess portion 37. In the locked position, the hydraulic oil is discharged through the main release oil passage 23 from the first recess portion 35, the second recess portion 36, and the third recess portion 37 so that each of the first lock member 31 and the second lock member 32 is fitted to either the first recess portion 35, the second recess portion 36, or the third recess portion 37. In a case where the electric power is supplied to the release control valve 25, the release control valve 25 is brought to the locked position. The release control valve 25 is brought to the unlocked position when the supply of the electric power is interrupted.

As illustrated in FIG. 1, the ECU 40 inputs signals from the shaft sensor 1S, an ignition switch 43, an accelerator pedal sensor 44, a brake pedal sensor 45, and the phase detection sensor 46. The ECU 40 outputs a signal for controlling each of the starter motor M, the fuel control device 5, and the ignition control device 6, and a signal for controlling the phase control valve 24 and the release control valve 25.

The ignition switch 43 serves as a switch for starting the internal combustion engine control system. The ignition switch 43 is turned on to start the engine E and is turned off to stop the engine E. In addition, the automatic stop and the automatic start of the engine E by the idling stop control become available when the ignition switch 43 is turned off.

The accelerator pedal sensor 44 detects a depression amount of an accelerator pedal. The brake pedal sensor 45 detects a depression amount of a brake pedal.

The engine control portion 41 achieves the start and stop of the engine E based on the operation of the ignition switch 43. In addition, the engine control portion 41 realizes the idling stop control for temporally stopping the engine E in a case where the engine E is stopped in the idling state.

The phase control portion 42 performs a timing control on the intake valve 1V by the valve timing control apparatus 10 while the engine E is operating, and specifies the relative rotation phase based on a condition when the engine E is stopped to thereby realize a locked state by either of the lock mechanisms L1, L2, and L3.

Figure 10:
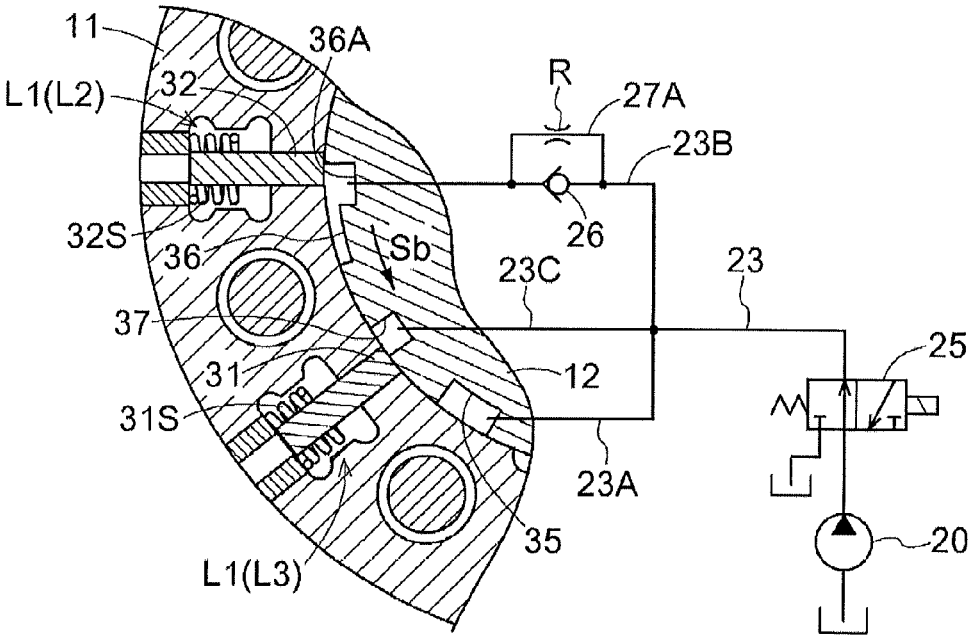
FIG. 10 is a schematic view illustrating the lock mechanism and the fluid control mechanism at a middle phase between the second intermediate lock phase and the most retarded angle lock phase.
Figure 11:
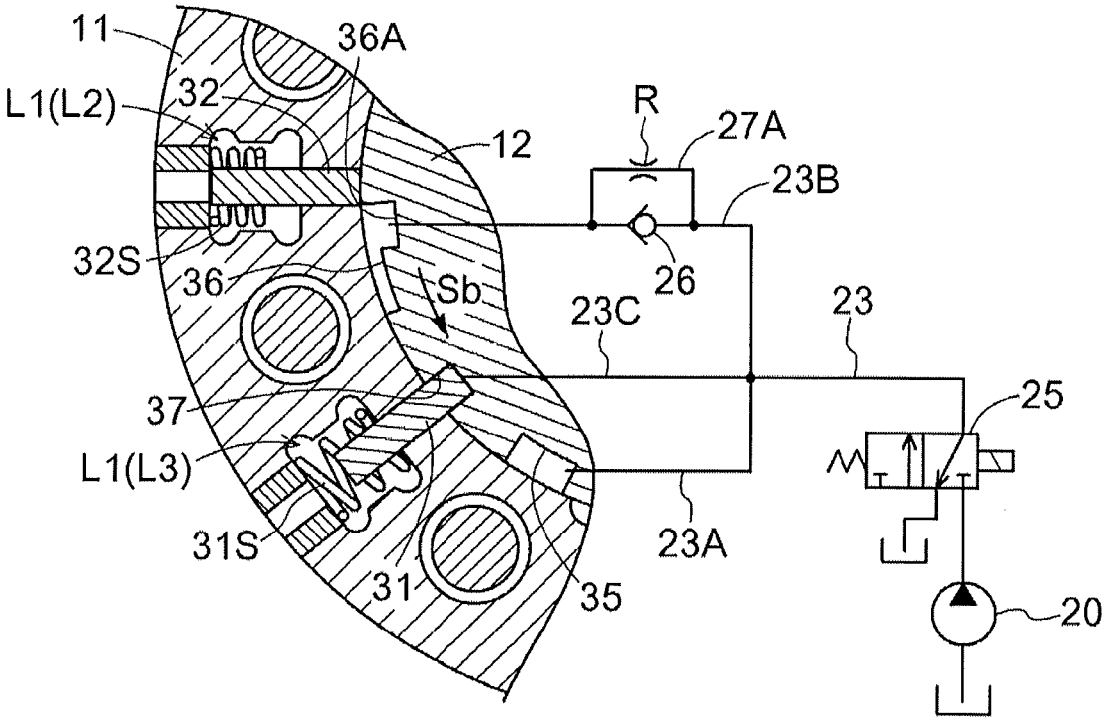
FIG. 11 is a schematic view illustrating the lock mechanism and the fluid control mechanism at the most retarded angle lock phase.
Figure 12:
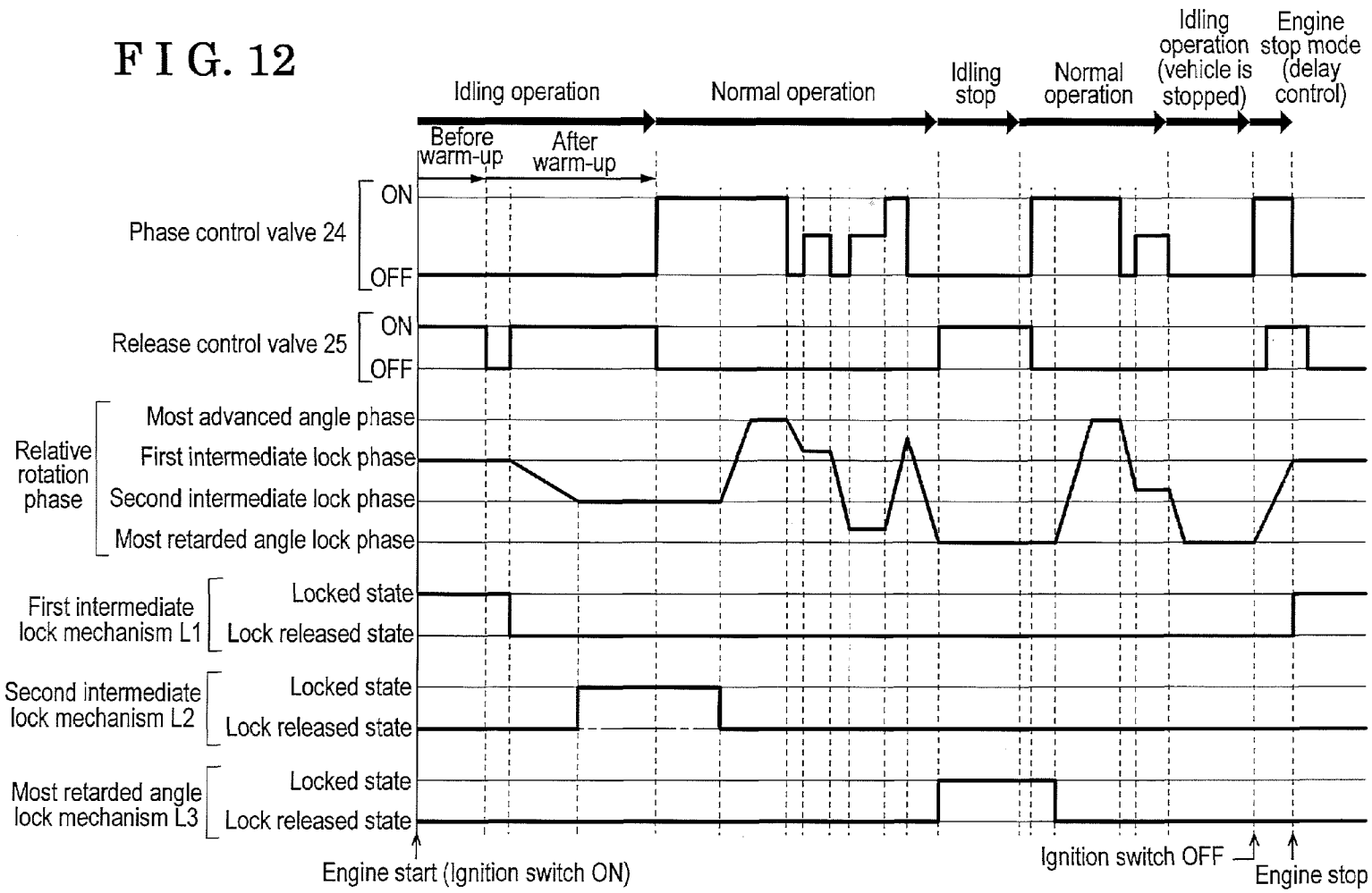
FIG. 12 is a time chart of a control of the valve timing control apparatus.

A normal start control of the internal combustion engine control system will be explained with reference to FIGS. 7 to 12. FIG. 12 is a time chart illustrating a control of the phase control valve 24, a control of the release control valve 25, a displacement of the relative rotation phase, a state of the first intermediate lock mechanism L1, a state of the second intermediate lock mechanism L2, and a state of the most retarded angle lock mechanism L3.

Figure 7:
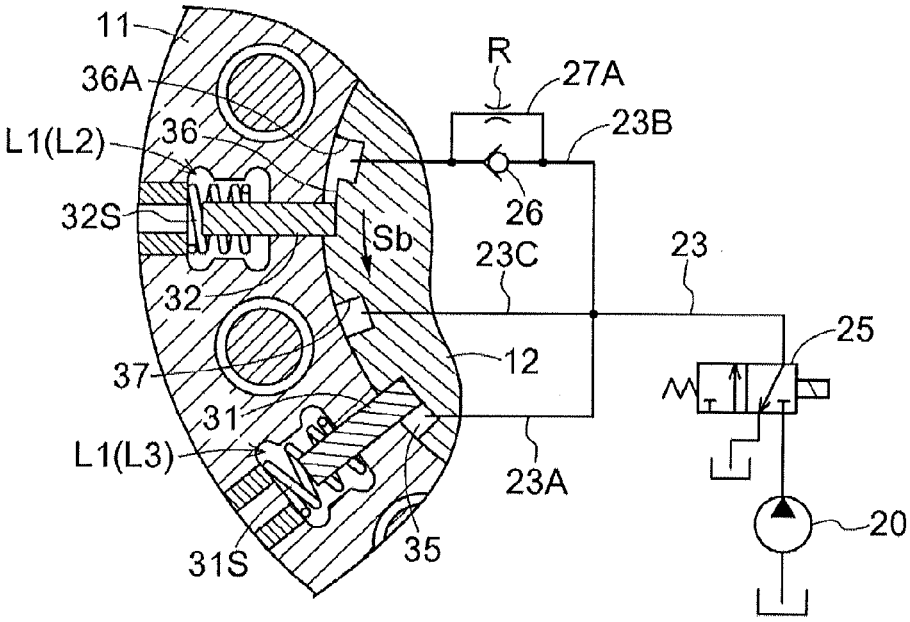
FIG. 7 is a schematic view illustrating a lock mechanism and a fluid control mechanism at the first intermediate lock phase.

In a state where the engine E is stopped while the engine is at a low temperature, the relative rotation phase is locked at the first intermediate lock phase P1 by the first intermediate lock mechanism L1 as illustrated in FIG. 7.

When the engine E is stopped at a low temperature, the hydraulic oil is discharged from the advanced angle chambers Ca and the retarded angle chambers Cb. The release control valve 25 is in the unlocked position, however, the hydraulic oil is discharged from any of the first recess portion 35, the second recess portion 36, and the third recess portion 37. The first lock member 31 fitted to the first recess portion 35 is in contact with the end portion of the inner surface of the first recess portion 35 in the advanced angle direction Sa. The second lock member 32 fitted to the second recess portion 36 is in contact with the end portion of the inner surface of the second recess portion 36 in the retarded angle direction Sb.

When the ignition switch 43 is turned on by a driver, for example, in the aforementioned state, the engine control portion 41 drives and rotates the starter motor M, controls the fuel control device 5 to supply fuel to the combustion chamber, and controls the ignition control device 6 to fire a spark plug. Accordingly, the engine E is started to initiate an idling operation (before a warm-up of catalyst). The release control valve 25 is powered at the same time the ignition switch 43 is turned on. The release control valve 25 is switched to the locked position to maintain the first intermediate lock phase P1 by the first intermediate lock mechanism L1. Because the relative rotation phase is locked at the first intermediate lock phase P1 between the most advanced angle phase and the most retarded angle phase, the engine E may be stably started.

The start of the engine E is detected on a basis of a detection signal from the phase detection sensor 46. After the start of the engine E, the phase control portion 42 displaces the relative rotation phase to the second intermediate lock phase P2 to obtain the locked state by the second intermediate lock mechanism L2.

Specifically, in a case where the relative rotation phase is maintained at the first intermediate lock phase P1 even after the catalyst warm-up is completed, HC emissions may increase. Thus, the phase control portion 42 shifts or displaces the relative rotation phase to the second intermediate lock phase P2 suitable for the idling operation (after the catalyst warm-up) to obtain the locked state by the second intermediate lock mechanism L2. Accordingly, the HC emissions during the idling operation may be restrained. In addition, the phase control portion 42 continuously interrupts the power supply to the phase control valve 24 so that the phase control valve 24 is held at the retarded angle position, i.e., performs a retarded angle control.

In order to obtain the locked state by the second intermediate lock mechanism L2, the phase control portion 42 supplies the electric power to the release control valve 25 for a time period determined beforehand, which will be hereinafter referred to as a set time, for retracting the first lock member 31 from the first recess portion 35. As a result, the release control valve 25 is switched from the locked position to the unlocked position so that the hydraulic oil is supplied to the main release oil passage 23 for the set time.

The hydraulic oil is supplied for the aforementioned set time so as to directly act on the first lock member 31 from the first release oil passage 23A. The first lock member 31 is retracted from the first recess portion 35 accordingly. At this time, the hydraulic oil is also supplied to the second release oil passage 23B. Nevertheless, because the orifice portion R is formed at the oil passage from the second release oil passage 23B to the second recess portion 36, the increase of the hydraulic oil pressure applied to the second lock member 32 is restrained and thus the second lock member 32 is inhibited from being retracted from the second recess portion 36.

Specifically, in a case where the hydraulic oil is supplied to the second release oil passage 23B, the ball 26 makes contact with the contact surface 27S by the pressure of the hydraulic oil flowing through the second release oil passage 23B, and the hydraulic oil flows only through the groove portion 27A. Thus, the volume of hydraulic oil flowing to the second recess portion 36 is limited or restricted. At the time when the first lock member 31 is retracted from the first recess portion 35, the oil pressure sufficient for the retraction of the second lock member 32 from the second recess portion 36 is not applied to the second lock member 32. As a result, the fitting state between the second lock member 32 and the second recess portion 36 is maintained.

Figure 8:
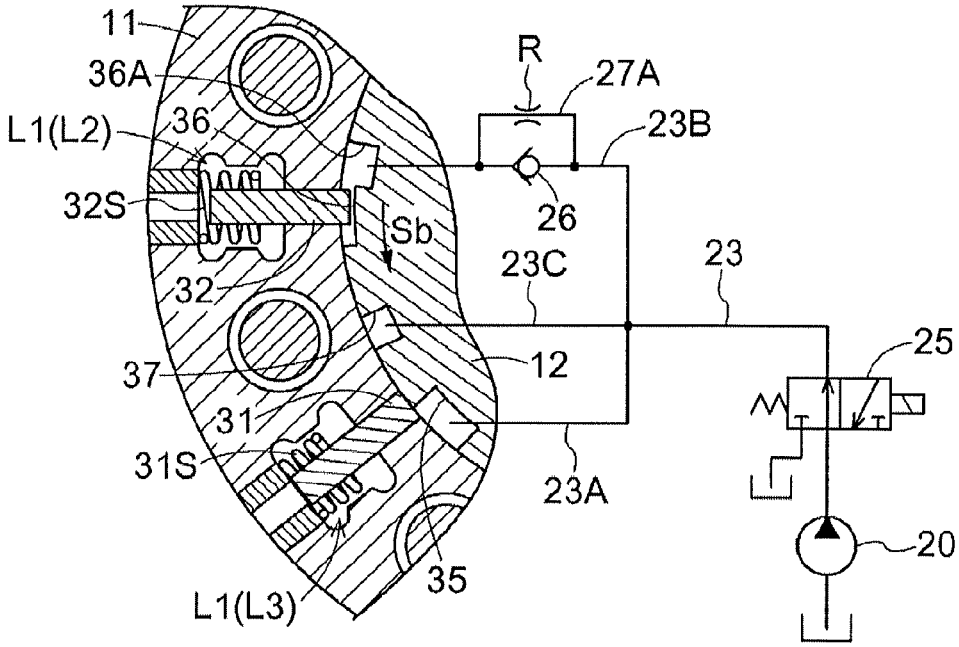
FIG. 8 is a schematic view illustrating the lock mechanism and the fluid control mechanism in a case where a relative rotation phase is changed from the first intermediate lock phase to the second intermediate lock phase.
Figure 9:
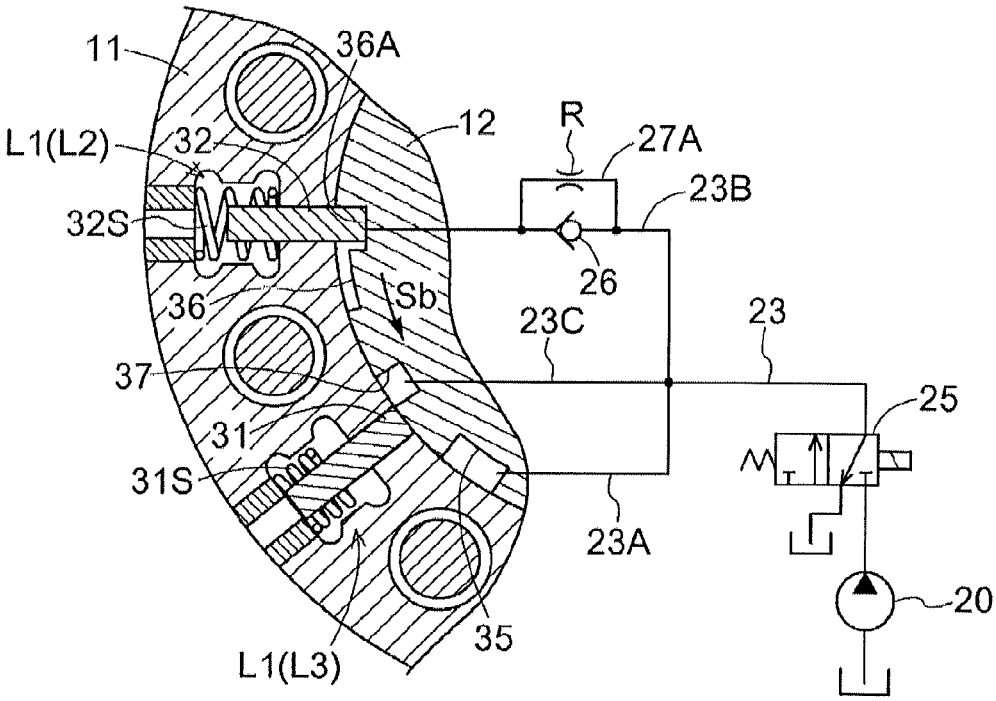
FIG. 9 is a schematic view illustrating the lock mechanism and the fluid control mechanism at the second intermediate lock phase.

When the first lock member 31 is retracted from the first recess portion 35, the relative rotation phase starts to be shifted in the retarded angle direction Sb by the retarded angle control of the phase control portion 42 as illustrated in FIG. 8. At this time, the release control valve 25 is in the locked position by being powered again. Thus, the supply of the hydraulic oil to the main release oil passage 23 has already been stopped. That is, at the time of shifting in the retarded angle direction Sb, the second lock member 32 is in a state to be fitted to the second recess portion 36. In a case where the relative rotation phase reaches the second intermediate lock phase P2, the second lock member 32 projects to be positioned into the fitting recess portion 36A of the second recess portion 36. Accordingly, the relative rotation phase is locked at the second intermediate lock phase P2 by the second intermediate lock mechanism L2 as illustrated in FIG. 9.

In the aforementioned normal start control, the engine E is started in a state where the temperature of the hydraulic oil is low and viscosity thereof is high. Thus, the flow passage resistance caused by the orifice portion R that is applied to the hydraulic oil supplied to the second lock member 32 via the second release oil passage 23B from the hydraulic pump 20 is large at the start of the engine E while the increase of pressure applied to the second lock member 32 is slow. Thus, time increases for the second lock member 32 to be retracted from the second recess portion 36 after the hydraulic oil is supplied to the main release oil passage 23 and then the first lock member 31 is retracted from the first recess portion 35. Accordingly, even when the aforementioned set time is not strictly specified, the first lock member 31 is securely retracted from the first recess portion 35 so that the relative rotation phase is shifted to the second intermediate lock phase P2. The relative rotation phase is locked at the second intermediate lock phase P2 by the second intermediate lock mechanism L2 to thereby restrain the HC emissions during the idling operation.

After the idling operation is finished, the internal combustion engine control system shifts the control to a normal operation control. The completion of the catalyst warm-up is determined by the ECU 40 based on a detection result of a water temperature sensor detecting the temperature of cooling water flowing through the inside of the engine E. In the normal operation control, the phase control portion 42 interrupts the power supply to the release control valve 25 so that the release control valve 25 is switched to the unlocked position from the locked position. Accordingly, the hydraulic oil is supplied to the main release oil passage 23 to thereby retract the second lock member 32 from the second recess portion 36 (the fitting recess portion 36A). Because the first lock member 31 has been already retracted from the first recess portion 35, the locked state between the outer rotor 11 and the inner rotor 12 is fully released (i.e., a lock released state). As long as the normal operation control is continued thereafter, the lock released state is maintained.

In the normal operation control, the phase control portion 42 performs an advanced angle control by supplying the electric power to the phase control valve 24 so that the phase control valve 24 is arranged at the advanced angle position to supply the hydraulic oil to the advanced angle chambers Ca, and the retarded angle control by interrupting the supply of the electric power to the phase control valve 24 so that the phase control valve 24 is arranged at the retarded angle position to supply the hydraulic oil to the retarded angle chambers Cb, depending on the load and the rotation speed, for example, of the engine E that is operating. As a result, the relative rotation phase is displaced to the advanced angle side relative to the first intermediate lock phase P1 or to the retarded angle side relative to the second intermediate lock phase P2 as illustrated in FIG. 10. In addition, the power supply to the phase control valve 24 is controlled so that the phase control valve 24 is arranged at the neutral position, i.e., the relative rotation phase is held at an arbitrary phase.

In the idling stop control, the engine E is temporarily stopped in a case where the brake pedal is depressed for stopping the vehicle (in a state where the accelerator pedal is not operated) during the normal operation, and the engine E is started in a case where the depression of the brake pedal is released. Accordingly, wasteful fuel consumption is restrained to improve fuel efficiency.

In a case where the engine E is stopped by the idling stop control, the power supply to the phase control valve 24 is interrupted in the normal operation state to thereby supply the hydraulic oil to the retarded angle chambers Cb. The relative rotation phase is displaced in the retarded angle direction Sb accordingly. Afterwards, in a case where the relative rotation phase reaches the vicinity of the most retarded angle phase, the release control valve 25 is supplied with power to be switched to the locked position so that the hydraulic oil is discharged from the third recess portion 37. At a time when the relative rotation phase reaches the most retarded angle lock phase P3 as illustrated in FIG. 11, the first lock member 31 is fitted to the third recess portion 37 so that the first lock member 31 is locked by the most retarded angle lock mechanism L3. Then, the engine control portion 41 stops the fuel supply to the combustion chamber by the fuel control device 5 and stop the ignition by the ignition control device 6, which results in the stop of the engine E.

In the idling stop control, the ignition of air-fuel mixture is easily performed because the engine E is started while the engine E is in a high temperature state. In a case where a cranking is performed with the relative rotation phase at the most retarded angle phase, the rotation of the crankshaft 1 may be smoothly performed at a low load. Accordingly, in a case where the engine E is stopped in the idling stop control, the relative rotation phase is locked at the most retarded angle lock phase P3. Then, when the depression of the brake pedal is released and the engine E is started, the cranking by the starter motor M is started.

In a case where the rotation speed of the crankshaft 1 reaches a predetermined value by the aforementioned cranking, the phase control portion 42 interrupts the power supply to the release control valve 25 to thereby switch the position of the release control valve 25 to the unlocked position. As a result, the first lock member 31 is retracted from the third recess portion 37 to release the locked state of the most retarded angle lock mechanism L3. In association with such control, the phase control valve 24 is switched to the advanced angle position to shift the relative rotation phase in the advanced angle direction Sa, and the fuel supply to the combustion chamber by the fuel control device 5 is performed. The ignition of the spark plug by the ignition control device 6 causes the engine E to restart accordingly. At the start of the engine E in the idling stop control, the relative rotation phase is configured to be locked at the most retarded angle lock phase P3 by the most retarded angle lock mechanism L3. Thus, each of the vanes 17 is inhibited from moving or rotating in the retarded angle direction or the advanced angle direction and from generating a hitting sound relative to a wall surface of the advanced angle chamber Ca or the retarded angle chamber Cb, thereby stably starting the engine E.

Before the ignition switch 43 is turned off by a driver, for example, while the engine E is operating, a stop operation is performed and the idling operation is initiated. At this time, the relative rotation phase is positioned at the most retarded angle phase. In a case where the ignition switch 43 is turned off by a driver, for example, the ECU 40 brings the internal combustion engine control system to an engine stop mode. In the engine stop mode, the engine E is not immediately stopped. That is, the phase control portion 42 supplies the electric power to the phase control valve 24 so that the phase control valve 24 is brought to the advanced angle position to supply the hydraulic oil to the advanced angle chambers Ca. The relative rotation phase is shifted to the first intermediate lock phase P1 as illustrated in FIG. 2 accordingly. In the shifting of the relative rotation phase to the first intermediate lock phase P1, the release control valve 25 is in the unlocked position. However, at a time when the relative rotation phase reaches the vicinity of the first intermediate lock phase P1, the release control valve 25 is supplied with the electric power to be switched to the locked position to thereby discharge the hydraulic oil from the first, second, and third recess portions 35, 36, and 37. Afterwards, the relative rotation phase is locked at the first intermediate lock phase P1 by the first intermediate lock mechanism L1.

In the aforementioned locked state of the relative rotation phase at the first intermediate lock phase P1, the first lock member 31 is in contact with the end portion of the inner surface of the first recess portion 35 in the advanced angle direction Sa in a state to be fitted to the first recess portion 35 by the biasing force of the first spring 31S. In addition, the second lock member 32 is fitted to the second recess portion 36 and is in contact with the end portion of the inner surface of the second recess portion 36 in the retarded angle direction Sb.

After the completion of the shifting of the relative rotation phase to the first intermediate lock phase P1, the engine control portion 41 stops the fuel supply to the combustion chamber by the fuel control device 5 and stops the ignition by the ignition control device 6 to thereby stop the engine E. After the engine E is completely stopped, the power supply to the release control valve 25 is interrupted. The engine E is stopped at the first intermediate lock phase P1 to thereby effectively start the engine E at a low temperature next time.

According to the aforementioned embodiment, in a case where the engine E is stopped by the idling stop control, the relative rotation phase is displaced to the most retarded angle lock phase P3 to be locked thereat by the most retarded angle lock mechanism L3. Thus, when the engine E is thereafter restarted, a light cranking may be achieved by a low compression ratio of intake air.

In a case where a driver turns off the ignition switch 43 to stop the engine E, the relative rotation phase is displaced to the first intermediate lock phase P1 to be locked thereat by the first intermediate lock mechanism L1. The engine E is then stopped. Accordingly, the engine E may be securely started next time while the engine E is at a low temperature.

After the start of the engine E, the hydraulic oil is supplied to the main release oil passage 23 for the set time to thereby retract the first lock member 31 from the first recess portion 35 while maintaining the fitted state between the second lock member 32 and the second recess portion 36. The relative rotation phase is securely shifted to the second intermediate lock phase P2.

Because the hydraulic oil is discharged from the single main release oil passage 23 to the first intermediate lock mechanism L1 and the second intermediate lock mechanism L2, the release control valve 25 including one output port and serving as a two-position switching valve may be used for supplying and discharging the hydraulic oil relative to the main release oil passage 23. Accordingly, as compared to a control valve including two output ports for supplying and discharging the hydraulic oil relative to the first intermediate lock mechanism L1 and the second intermediate lock mechanism L2 separately, the configuration of the release control valve 25 may be simplified. One oil passage is sufficient for supplying and discharging the hydraulic oil relative to the release control valve 25, the first intermediate lock mechanism L1, and the second intermediate lock mechanism L2.

According to the present embodiment, the single main release oil passage 23 is divided into the first release oil passage 23A, the second release oil passage 23B, and the third release oil passage 23C. Alternatively, the first, second, and third release oil passages 23A, 23B, and 23C may be individually and separately formed. At this time, the release control valves may be independently provided.

A second embodiment will be explained with reference to FIG. 13. The substantially same configurations of the second embodiment as those of the first embodiment bear the same numeral references and an explanation thereof will be omitted.

Figure 13:
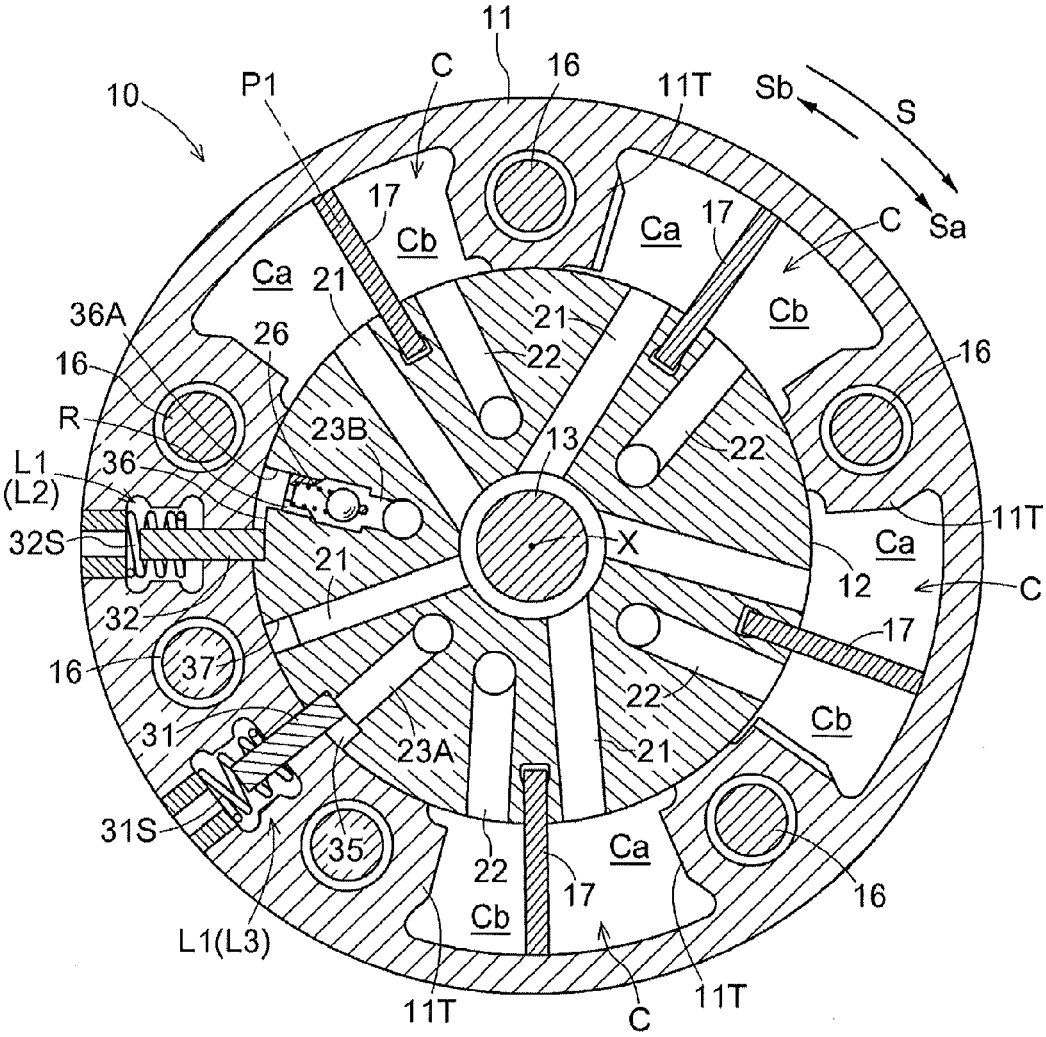
FIG. 13 is a cross-sectional view illustrating the first intermediate lock phase of the valve timing control apparatus according to a second embodiment.

As illustrated in FIG. 13, the main release oil passage 23 is divided into the first release oil passage 23A for supplying and discharging the hydraulic oil relative to the first recess portion 35, and the second release oil passage 23B for supplying and discharging the hydraulic oil relative to the second recess portion 36. The hydraulic oil is supplied and discharged relative to the third recess portion 37 by the advanced angle control oil passage 21. That is, the main release oil passage 23 (the common flow passage) supplies and discharges the hydraulic oil relative to the first intermediate lock mechanism L1 and the second intermediate lock mechanism L2. In addition, an oil passage supplying and discharging the hydraulic oil relative to the most retarded angle lock mechanism L3 serves as an oil passage supplying and discharging the hydraulic oil relative to the advanced angle chambers Ca.

According to the most retarded angle lock mechanism L3, the first lock member 31 is fitted to the third recess portion 37 in a state where the relative rotation phase is arranged at the most retarded angle lock phase P3. At this time, the hydraulic oil is discharged from both the third recess portion 37 and the advanced angle chambers Ca. On the other hand, in a state where the relative rotation phase is not arranged at the most retarded angle lock phase P3, the first lock member 31 is retracted from the third recess portion 37 and the hydraulic oil is supplied to both the third recess portion 37 and the advanced angle chambers Ca.

That is, timing of supplying and discharging the hydraulic oil relative to the third recess portion 37 matches timing of supplying and discharging the hydraulic oil relative to the advanced angle chambers Ca. Thus, the most retarded angle lock mechanism L3 may be correctly operated in a configuration where the supply and discharge of the hydraulic oil relative to the third recess portion 37 are performed by the advanced angle control oil passage 21.

The aforementioned embodiments may be modified as follows.

Figure 14:
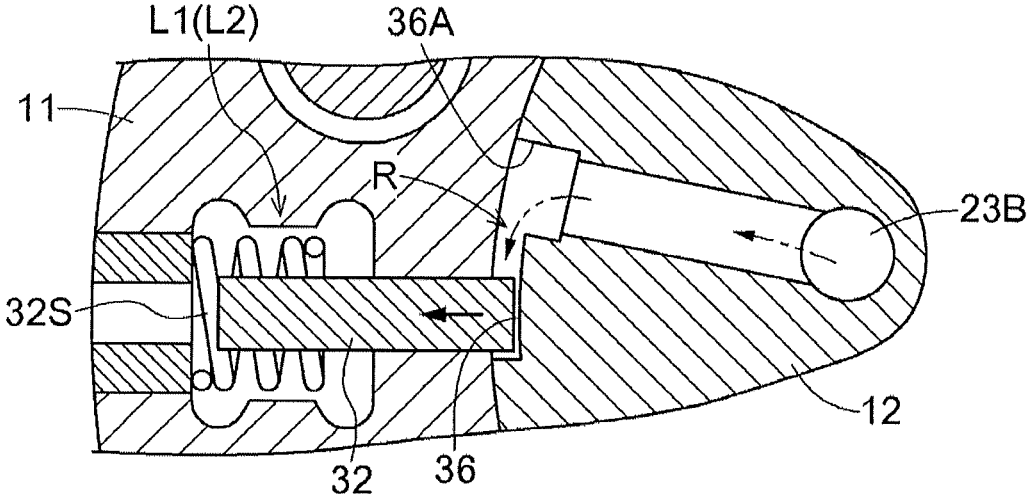
FIG. 14 is a cross-sectional view illustrating a configuration of another example of the orifice portion.

As illustrated in FIG. 14, the cross section of flow passage of the second recess portion 36 serving as the orifice portion R may be reduced so that the portion of the second recess portion 36 constitutes the additional, i.e., second orifice portion R. That is, the fluid passage at the second recess portion 36 is formed by a void defined by the second recess portion 36 and the inner surface of the outer rotor 11 positioned at a radially outer side of the second recess portion 36. The second recess portion 36 is formed to be shallow to reduce the cross section of flow passage thereof for constituting the orifice portion R. Specifically, the two orifice portions R, i.e., the orifice portion R achieved by the ball 26 and the orifice portion R achieved by the second recess portion 36, may be provided.

According to the aforementioned embodiments, the orifice portion R serves as the delay portion. Alternatively, a void like an accumulator, for example, may serve as the delay portion to be formed at a branch oil passage branched from the second release oil passage 23B so as to guide and lead out the hydraulic oil to the void at a time of pressure increase. As a result, in a case where the hydraulic oil is supplied to the second lock member 32 from the main release oil passage 23, the flow of hydraulic oil is led out to the branch oil passage to thereby restrain and delay the pressure increase acting on the second lock member 32. The retraction of the second lock member 32 from the second recess portion 36 may be restrained.

In addition, a temperature sensor may be provided to measure the hydraulic oil temperature. Then, the set time for supplying the hydraulic oil to the main release oil passage 23 may be adjusted on a basis of a detection result of the temperature sensor. Accordingly, in a case where the hydraulic oil temperature varies depending on the season, for example, the first lock member 31 is securely retracted from the first recess portion 35.

Further, in a case where it is detected that the relative rotation phase is displaced beyond the second intermediate lock phase P2 to the most retarded angle side when the relative rotation phase is displaced from the first intermediate lock phase P1 to the second intermediate lock phase P2, the relative rotation phase may be controlled to be displaced in the advanced angle direction Sa. As a result, the relative rotation phase may be securely locked at the second intermediate lock phase P2. In a case where the relative rotation phase is unable to be locked at the second intermediate lock phase P2, the set time for supplying the hydraulic oil to the main release oil passage 23 may be reduced.

Furthermore, the first lock member 31 and the second lock member 32 may be slidable and movable relative to the inner rotor 12 in a direction parallel to the axis X. Then, the first recess portion 35 and the second recess portion 36 to which the first lock member 31 and the second lock member 32 are fitted respectively may be formed at the front plate 14 or the rear plate 15. As a result, a member including a large diameter is used for the first and second lock members 31 and 32, which may lead to a strong locked state.

Furthermore, the first lock member 31 and the second lock member 32 may be formed at the outer rotor 11 while the first recess portion 35 and the second recess portion 36 to which the first lock member 31 and the second lock member 32 are fitted respectively may be formed at the inner rotor 12.

The aforementioned embodiments are applicable to the valve timing control apparatus 10 controlling the relative rotation phase of the driven-side rotation member (the inner rotor 12) relative to the driving-side rotation member (the outer rotor 11) rotating in synchronization with the crankshaft 1 of the internal combustion engine E.

According to the aforementioned embodiments, the relative rotation phase is locked at the first intermediate lock phase P1 between the most advanced angle phase and the most retarded angle phase by the first intermediate lock mechanism L1 to thereby stably start the engine E. In addition, the relative rotation phase is locked at the second intermediate lock phase P2 by the second intermediate lock mechanism L2 to thereby restrain the HC emissions at the time of idling of the engine E. Further, even in a case where the relative rotation phase is difficult to be stably maintained at the start of the engine E in the idling stop control, the relative rotation phase may be locked at the most retarded angle lock phase P3 by the most retarded angle lock mechanism L3. Therefore, each of the vanes 17 is inhibited from moving or rotating in the retarded angle direction or the advanced angle direction and from generating a hitting sound relative to a wall surface of the advanced angle chamber Ca or the retarded angle chamber Cb, thereby stably starting the engine E.

According to the aforementioned embodiments, the valve timing control apparatus 10 includes the first lock member 31 and the second lock member 32 formed at one of the outer rotor 11 and the inner rotor 12, and the first recess portion 35, the second recess portion 36, and the third recess portion 37 formed at the other of the outer rotor 11 and the inner rotor 12. At least one of the first lock member 31 and the second lock member 32 engages with at least one of the first recess portion 35, the second recess portion 36, and the third recess portion 37 to lock the relative rotation at either one of the first intermediate lock phase P1, the second intermediate lock phase P2, and the most retarded angle lock phase P3.

Accordingly, the individual lock members and recess portions are not necessary for the first intermediate lock mechanism L1, the second intermediate lock mechanism L2, and the most retarded angle lock mechanism L3 respectively. Therefore, the number of components of the valve timing control apparatus 10 may be reduced, which results in reduction of cost and size of the valve timing control apparatus 10.

The valve timing control apparatus 10 includes the first release oil passage 23A supplying the hydraulic oil in a direction for retracting the first lock member 31 from the first recess portion 35, the second release oil passage 23B supplying the hydraulic oil in a direction for retracting the second lock member 32 from the second recess portion 36, the first release oil passage 23A and the second release oil passage 23B being configured to be supplied with the hydraulic oil from the single main release oil passage 23, and the orifice portion R restraining the flow of hydraulic oil supplied to the second lock member 32 from the second release oil passage 23B. The first intermediate lock mechanism L1 locks the relative rotation phase at the first intermediate lock phase P1 by the first lock member 31 engaging with the first recess portion 35 and the second lock member 32 engaging with the second recess portion 36. The second intermediate lock mechanism L2 locks the relative rotation phase at the second intermediate lock phase P2 by the second lock member 32 making contact with the end portion of the second recess portion 36 formed in a groove by a displacement of the relative rotation phase in the retarded angle direction Sb in a state where the second lock member 32 engages with the second recess portion 36.

Accordingly, in a case where the relative rotation phase is displaced to the second intermediate lock phase P2 from the state where the relative rotation phase is locked at the first intermediate lock phase P1 by the first intermediate lock mechanism L1, the hydraulic oil is supplied to the main release oil passage 23 while the hydraulic oil is supplied to the retarded angle chambers Cb. Then, because of the pressure of hydraulic oil sent from the main release oil passage 23 to the first release oil passage 23A, the first lock member 31 is retracted from the first recess portion 35. In addition, when the hydraulic oil is supplied to the main release oil passage 23, the flow of hydraulic oil sent to the second release oil passage 23B from the main release oil passage 23 is restrained by the orifice portion R. Thus, the operation of the second lock member 32 in the retracted direction is delayed. The state where the second lock member 32 is fitted to the second recess portion 36 may be maintained at timing at which the first lock member 31 is retracted from the first recess portion 35. Accordingly, by the supply of hydraulic oil for the set time to the main release oil passage 23, the state where the second lock member 32 is fitted to the second recess portion 36 is maintained after the first lock member 31 is retracted from the first recess portion 35 and the relative rotation phase is started to be displaced in the retarded angle direction. Then, by the displacement of the relative rotation phase in the retarded angle direction, the second lock member 32 makes contact with the end portion of the second recess portion 36 at the retarded angle side to thereby restrict the relative rotation phase at the second intermediate lock phase P2 by the second intermediate lock mechanism L2. At this time, an individual oil passage (flow passage) is not necessary for controlling the hydraulic oil supplied to each of the first release oil passage 23A and the second release oil passage 23B. In addition, a valve element of a two-position switching type is used for controlling the hydraulic oil, which results in a simplified configuration.

The valve timing control apparatus 10 includes the first release oil passage 23A supplying the hydraulic oil in a direction for retracting the first lock member 31 from the first recess portion 35, the second release oil passage 23B supplying the hydraulic oil in a direction for retracting the second lock member 32 from the second recess portion 36, the first release oil passage 23A and the second release oil passage 23B being configured to be supplied with the hydraulic oil from the single main release oil passage 23, and the delay portion R provided at one of the first release oil passage 23A and the second release oil passage 23B to restrain the flow of hydraulic oil supplied from one of the first release oil passage (23A) and the second release oil passage (23B) and to differentiate timing at which the hydraulic oil is started to be supplied to the first lock member 31 from timing at which the hydraulic oil is started to be supplied to the second lock member 32 in a case where the hydraulic oil is supplied to the first lock member 31 and the second lock member 32 from the main release oil passage 23.

Because of the orifice portion R, the timing at which the hydraulic oil is supplied to the first lock member 31 and the timing at which the hydraulic oil is supplied to the second lock member 32 are differentiated even in a case where the hydraulic oil is simultaneously supplied to the first lock member 31 and the second lock member 32 from the single main release oil passage 23. Thus, even in a case where one supply source of hydraulic oil or one member for controlling the hydraulic oil is provided, for example, a state where both of the first lock member 31 and the second lock member 32 are fitted to the first recess portion 35 and the second recess portion 36 respectively, and a state where one of the first lock member 31 and the second lock member 32 is fitted to one of the first recess portion 35 and the second recess portion 36 may be both obtained.

The valve timing control apparatus 10 includes the main release oil passage 23 (the common flow passage) serving as a common portion of oil passages supplying and discharging the hydraulic oil relative to the first intermediate lock mechanism L1, the second intermediate lock mechanism L2, and the most retarded angle lock mechanism L3 respectively.

Accordingly, individual oil passages (flow passages) are not necessary for the first intermediate lock mechanism L1, the second intermediate lock mechanism L2, and the most retarded angle lock mechanism L3. Therefore, manufacturing man-hours for the oil passages may be reduced to thereby achieve a reduced cost of the valve timing control apparatus 10. In addition, the volume occupied by the oil passages is reduced, which may result in a reduced size of the valve timing control apparatus 10.

The valve timing control apparatus 10 includes the main release oil passage 23 (the common flow passage) supplying and discharging the hydraulic oil relative to the first intermediate lock mechanism L1 and the second intermediate lock mechanism L2. The oil passage supplying and discharging the hydraulic oil relative to the most retarded angle lock mechanism L3 serves as the oil passage supplying and discharging the hydraulic oil relative to the advanced angle chambers Ca.

Because of the main release oil passage 23 (the common flow passage), the individual oil passages are not necessary for the first intermediate lock mechanism L1, the second intermediate lock mechanism L2, and the most retarded angle lock mechanism L3. In addition, because the oil passage for supplying and discharging the hydraulic oil relative to the most retarded angle lock mechanism L3 also serves as the oil passage for supplying and discharging the hydraulic oil relative to the advanced angle chambers Ca, an additional oil passage is not necessary for the most retarded angle lock mechanism L3. Thus, manufacturing man-hours for the oil passage may be reduced to thereby achieve a reduced cost of the valve timing control apparatus 10. In addition, the volume occupied by the oil passage is reduced, which may result in a reduced size of the valve timing control apparatus 10.

The orifice portion R is configured in a manner that the cross-section of the second release oil passage 23B is specified to be smaller than the cross-section of the first release oil passage 23A.

Because the orifice portion R is configured on a basis of the cross-section of the second release oil passage 23B, a specific component, for example, is not necessary, which results in a simplified assembly and a reduced cost.

The internal combustion engine control system includes the phase control valve 24 selecting one of the advanced angle chamber Ca and the retarded angle chamber Cb of the valve timing control apparatus 10 to supply the hydraulic oil to the selected chamber, the release control valve 25 supplying the hydraulic oil to the main release oil passage 23, and the ECU 40 controlling the phase control valve 24 and the release control valve 25. The ECU 40 controls to supply the hydraulic oil to the retarded angle chamber Cb by controlling the phase control valve 24 and to supply the hydraulic oil to the main release oil passage 23 for the set time by controlling the release control valve 25 in a case where the engine E is started in a state where the relative rotation phase is arranged at the first intermediate lock phase P1.

Accordingly, in a case where the engine E is started in a state where the relative rotation phase is positioned at the first intermediate lock phase P1 and thereafter the relative rotation phase is displaced to the second intermediate lock phase P2, the phase control valve 24 is controlled to supply the hydraulic oil to the retarded angle chambers Cb and to supply the hydraulic oil to the main release oil passage 23 for the set time by controlling the release control valve 25. As a result, the second lock member 32 is maintained to be fitted to the second recess portion 36 after the first lock member 31 is retracted from the first recess portion 35 and the relative rotation phase is started to be displaced to the retarded angle side. Afterwards, the relative rotation phase is displaced to the retarded angle side so that the second lock member 32 makes contact with the end portion of the second recess portion 36 at the retarded angle side to restrict the relative rotation phase at the second intermediate lock phase P2 by the second intermediate lock mechanism L2.

The orifice portion R is configured to include the ball 26 moving to a position at which the volume of hydraulic oil flowing through the second release oil passage 23B is limited in a case where the hydraulic oil is supplied to the second release oil passage 23B and moving to a position at which the volume of hydraulic oil flowing through the second release oil passage 23B is inhibited from being limited in a case where the hydraulic oil is discharged from the second release oil passage 23B.

Accordingly, the ball 26 restricts the flow of hydraulic oil when the hydraulic oil is supplied to the second release oil passage 23B so as to restrain the operation of the second lock member 32. In addition, the ball 26 allows the hydraulic oil to flow without limitation when the hydraulic oil is discharged from the second release oil passage 23B so that the second lock member 32 is promptly operated to project.

The valve timing control apparatus 10 includes the orifice portion R causing the hydraulic oil to be delayed in reaching the second intermediate lock mechanism L2 as compared to the hydraulic oil to reach the first intermediate lock mechanism L1 in a case where the hydraulic oil is supplied to the first intermediate lock mechanism L1 and the second intermediate lock mechanism L2.

Accordingly, the release control valve 25 including one output port and serving as a two-position switching valve may be used at the main release oil passage 23 (the common flow passage). Thus, as compared to a control valve including two output ports for supplying and discharging the hydraulic oil relative to the first intermediate lock mechanism L1 and the second intermediate lock mechanism L2 separately, the configuration of the release control valve 25 may be simplified. One oil passage is sufficient for supplying and discharging the hydraulic oil relative to the release control valve 25, the first intermediate lock mechanism L1, and the second intermediate lock mechanism L2.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus comprising:

a driving-side rotation member rotating in synchronization with a crankshaft of an internal combustion engine;

a driven-side rotation member arranged coaxial with the driving-side rotation member and rotating in synchronization with a camshaft for opening and closing a valve of the internal combustion engine;

a fluid chamber formed by the driving-side rotation member and the driven-side rotation member;

an advanced angle chamber and a retarded angle chamber formed by divided portions of the fluid chamber divided by a partition member that is provided at least one of the driving-side rotation member and the driven-side rotation member;

a fluid control mechanism controlling supply and discharge of fluid relative to the fluid chamber;

a first intermediate lock mechanism configured to selectively lock a relative rotation phase of the driven-side rotation member relative to the driving-side rotation member at a first intermediate lock phase between a most advanced angle phase and a most retarded angle phase and release a locked state of the relative rotation phase at the first intermediate lock phase;

a most retarded angle lock mechanism configured to selectively lock the relative rotation phase at a most retarded angle lock phase and release a locked state of the relative rotation phase at the most retarded angle lock phase; and a second intermediate lock mechanism configured to selectively lock the relative rotation phase at a second intermediate lock phase between the first intermediate lock phase and the most retarded angle lock phase and release a locked state of the relative rotation phase at the second intermediate lock phase.

2. The valve timing control apparatus according to claim 1, further comprising:

a first lock member and a second lock member formed at one of the driving-side rotation member and the driven-side rotation member; and a first recess portion, a second recess portion, and a third recess portion formed at the other of the driving-side rotation member and the driven-side rotation member, wherein at least one of the first lock member and the second lock member engages with at least one of the first recess portion, the second recess portion, and the third recess portion to lock the relative rotation at either one of the first intermediate lock phase, the second intermediate lock phase, and the most retarded angle lock phase.

3. The valve timing control apparatus according to claim 1, further comprising:

a first release flow passage supplying fluid in a direction for retracting the first lock member from the first recess portion, a second release flow passage supplying fluid in a direction for retracting the second lock member from the second recess portion, the first release flow passage and the second release flow passage being configured to be supplied with fluid from a single main release flow passage; and a delay portion restraining a flow of fluid supplied to the second lock member from the second release flow passage, wherein the first intermediate lock mechanism locks the relative rotation phase at the first intermediate lock phase by the first lock member engaging with the first recess portion and the second lock member engaging with the second recess portion, and the second intermediate lock mechanism locks the relative rotation phase at the second intermediate lock phase by the second lock member making contact with an end portion of the second recess portion formed in a groove by a displacement of the relative rotation phase in a retarded angle direction in a state where the second lock member engages with the second recess portion.

4. The valve timing control apparatus according to claim 1, further comprising:

a first release flow passage supplying fluid in a direction for retracting the first lock member from the first recess portion, a second release flow passage supplying fluid in a direction for retracting the second lock member from the second recess portion, the first release flow passage and the second release flow passage being configured to be supplied with fluid from a single main release flow passage; and a delay portion provided at one of the first release flow passage and the second release flow passage to restrain a flow of fluid supplied from the one of the first release flow passage and the second release flow passage and to differentiate timing at which fluid is started to be supplied to the first lock member from timing at which fluid is started to be supplied to the second lock member in a case where fluid is supplied to the first lock member and the second lock member from the main release fluid passage.

5. The valve timing control apparatus according to claim 1, further comprising a common flow passage serving as a common portion of flow passages supplying and discharging fluid relative to the first intermediate lock mechanism, the second intermediate lock mechanism, and the most retarded angle lock mechanism respectively.

6. The valve timing control apparatus according to claim 2, further comprising a common flow passage serving as a common portion of flow passages supplying and discharging fluid relative to the first intermediate lock mechanism, the second intermediate lock mechanism, and the most retarded angle lock mechanism respectively.

7. The valve timing control apparatus according to claim 1, further comprising a common flow passage supplying and discharging fluid relative to the first intermediate lock mechanism and the second intermediate lock mechanism, wherein a flow passage supplying and discharging fluid relative to the most retarded angle lock mechanism serves as a flow passage supplying and discharging fluid relative to the advanced angle chamber.

8. The valve timing control apparatus according to claim 2, further comprising a common flow passage supplying and discharging fluid relative to the first intermediate lock mechanism and the second intermediate lock mechanism, wherein a flow passage supplying and discharging fluid relative to the most retarded angle lock mechanism serves as a flow passage supplying and discharging fluid relative to the advanced angle chamber.

9. The valve timing control apparatus according to claim 3, wherein the delay portion is configured in a manner that a cross-section of the second release flow passage is specified to be smaller than a cross-section of the first release flow passage.

10. An internal combustion engine control system comprising:

a phase control valve selecting one of an advanced angle chamber and a retarded angle chamber of the valve timing control apparatus according to claim 3 to supply fluid to the selected chamber;

a release control valve supplying fluid to a main release flow passage; and a control unit controlling the phase control valve and the release control valve, the control unit controlling to supply fluid to the retarded angle chamber by controlling the phase control valve and to supply fluid to the main release flow passage for a set time by controlling the release control valve in a case where an internal combustion engine is started in a state where the relative rotation phase is arranged at the first intermediate lock phase.

11. The valve timing control apparatus according to claim 3, wherein the delay portion is configured to include a flow control member moving to a position at which a volume of fluid flowing through the second release flow passage is limited in a case where fluid is supplied to the second release flow passage and moving to a position at which the volume of fluid flowing through the second release flow passage is inhibited from being limited in a case where fluid is discharged from the second release flow passage.

12. The valve timing control apparatus according to claim 9, wherein the delay portion is configured to include a flow control member moving to a position at which a volume of fluid flowing through the second release flow passage is limited in a case where fluid is supplied to the second release flow passage and moving to a position at which the volume of fluid flowing through the second release flow passage is inhibited from being limited in a case where fluid is discharged from the second release flow passage.

13. The valve timing control apparatus according to claim 5, further comprising a delay portion causing fluid to be delayed in reaching the second intermediate lock mechanism as compared to fluid to reach the first intermediate lock mechanism in a case where fluid is supplied to the first intermediate lock mechanism and the second intermediate lock mechanism.

14. The valve timing control apparatus according to claim 7, further comprising a delay portion causing fluid to be delayed in reaching the second intermediate lock mechanism as compared to fluid to reach the first intermediate lock mechanism in a case where fluid is supplied to the first intermediate lock mechanism and the second intermediate lock mechanism.

* * * * *